US006156472A

United States Patent [19]

Segi et al.

[11] Patent Number: 6,156,472

[45] **Date of Patent: *Dec. 5, 2000**

[54] METHOD OF MANUFACTURING ELECTROPHOTOGRAPHIC PHOTOSENSITIVE MEMBER

[75] Inventors: Yoshio Segi; Hideaki Matsuoka; Hiroyuki Katagiri; Yasuyoshi Takai, all of Nara, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/186,421

[22] Filed: Nov. 5, 1998

[30] Foreign Application Priority Data

Nov. 6, 1997 [JP] Japan ..... 9-304266
Dec. 26, 1997 [JP] Japan ..... 9-361045

[51] Int. Cl.[7] ..... G03G 5/10
[52] U.S. Cl. ..... 430/128; 430/127
[58] Field of Search ..... 430/127, 128

[56] References Cited

U.S. PATENT DOCUMENTS 4,504,518 3/1985 Ovshinsky et al. ..... 427/38
5,635,327 6/1997 Fukuda et al. ..... 430/128
5,849,455 12/1998 Ueda et al. ..... 430/128

FOREIGN PATENT DOCUMENTS 086341 7/1979 Japan .
193463 11/1984 Japan .
186849 9/1985 Japan .
262936 12/1985 Japan .
171798 8/1986 Japan .
231561 10/1986 Japan .
273551 12/1986 Japan .
283116 12/1986 Japan .
095545 5/1987 Japan .
264764 11/1988 Japan .
311261 12/1988 Japan .
130159 5/1989 Japan .
156758 6/1989 Japan .
6-089033 3/1994 Japan .
6-202363 7/1994 Japan .
273955 9/1994 Japan .
8-44090 2/1996 Japan .

*Primary Examiner*—John Goodrow
*Attorney, Agent, or Firm*—Fitzpatrick, Cella, Harper & Scinto

[57] ABSTRACT

To provide an electrophotographic photosensitive member manufacturing method capable of preventing a substrate from corroding in working of the substrate and obtaining a high-quality image free from image defects and image density unevenness, the method of manufacturing an electrophotographic photosensitive member comprises the step of forming a functional film made of an amorphous material on the surface of an aluminum substrate by reduced-pressure vapor deposition, wherein the surface of the substrate is cleaned with the water containing an inhibitor as a specific component before the step of forming an electrophotographic photosensitive member.

45 Claims, 7 Drawing Sheets

METHOD OF MANUFACTURING ELECTROPHOTOGRAPHIC PHOTOSENSITIVE MEMBER

BACKGROUND OF THE INVENTION

1. Field of the Invention

The present invention relates to a method of manufacturing an electrophotographic photosensitive member which comprises forming a functional film.

2. Related Background Art

Glass, heat-resistant synthetic resin, stainless steel, and aluminum are proposed as a substrate for forming a deposited film of an electrophotographic photosensitive member. Practically, however, a metal is frequently used as the substrate in order to withstand such photographic processes as charging, exposure, development, transfer and cleaning and always keep a high positional accuracy without deteriorating the picture quality. Particularly, aluminum is one of the optimum materials as the substrate of an electrophotographic photosensitive member because it has a high workability and a low cost and is lightweight.

The technologies concerned with the material of the substrate of an electrophotographic photosensitive member are disclosed in Japanese Patent Application Laid-Open Nos. 59-193463 and 60-262936. Japanese Patent Application Laid-Open No. 59-193463 discloses the technology for obtaining an amorphous-silicon electrophotographic photosensitive member showing a high picture quality by using an aluminum alloy having an Fe content of 2,000 ppm or less as a support. Moreover, it discloses the procedures of cutting a cylindrical substrate with a lathe and mirror-finishing it and thereafter forming amorphous silicon by glow discharge. Japanese Patent Application Laid-Open No. 60-262936 discloses an extruded aluminum alloy superior in the vapor deposition characteristic of amorphous silicon containing 3.0 to 6.0 wt % of Mg, and as controlled impurities, Mn amount not more than 0.3 wt %, Cr amount less than 0.01 wt %, Fe amount not more than 0.15 wt %, Si amount not more than 0.12 wt % and the remainder of Al.

These materials undergo a substrate surface treatment in accordance with applications of an electrophotographic photosensitive member and a light receiving layer is formed on the substrate surface. The technology concerned with the substrate surface treatment is disclosed in Japanese Patent Application Laid-Open Nos. 61-231561 and 62-95545. Japanese Patent Application Laid-Open No. 61-231561 discloses the method of naturally dropping a rigid complete sphere to form irregularity on the surface of a metallic support by the trace dent of the sphere. Japanese Patent Application Laid-Open No. 62-95545 discloses the method of forming irregularity by a solution obtained by mixing polybutene and triethane (trichloroethane: $C_2H_3Cl_3$). It is described that these technologies are effective for generation of an interference fringe on a picture.

Moreover, concerning a method of working a substrate before surface roughening, Japanese Patent Application Laid-Open No. 61-171798 discloses the technology for obtaining an electrophotographic photosensitive member such as of high-quality amorphous silicon by cutting a substrate with a cutting lubricant containing a specific component. Furthermore, it is disclosed cleaning the substrate with triethane (trichloroethane: $C_2H_3Cl_3$) after cutting. However, it does not disclose cleaning with water containing a specific inhibitor at all.

Furthermore, as a corrosion-preventive technology for the water cleaning step when using an aluminum alloy as a substrate, Japanese Patent Application Laid-Open No. 6-273955 proposes the technology for cleaning a substrate with water containing carbon dioxide. However, cleaning with water containing a specific inhibitor is not described at all. Furthermore, it does not disclose at all defining a film thickness and a composition ratio in a certain range by water containing a specific inhibitor.

Furthermore, Japanese Patent Application Laid-Open Nos. 63-311261 and 1-156758 and Japanese Patent Publication No. 7-341223 respectively disclose the technology for forming an oxide film on an Al substrate. However, they do not disclose forming a film by cleaning with water containing an inhibitor as a specific component.

Japanese Patent Application Laid-Open No. 61-273551 discloses the technologies for alkaline cleaning, trichloroethylene cleaning, and ultraviolet irradiation cleaning by using a mercury lamp as pretreatment of a substrate when manufacturing an electrophotographic photosensitive member by vapor-depositing Se or the like on an aluminum substrate. Moreover, it discloses performing liquid degreasing cleaning, steam degreasing cleaning, and pure water cleaning for removing fat attached to the surface of a cylindrical aluminum substrate as the pretreatment of ultraviolet irradiation cleaning. Furthermore, Japanese Patent Application Laid-Open No. 63-264764 discloses the technology for roughening the surface of a substrate with a water jet. However, it does not disclose cleaning with water containing a specific inhibitor at all.

Japanese Patent Application Laid-Open No. 1-130159 discloses the technology for cleaning an electrophotographic photosensitive member support by water jet. It discloses amorphous silicon in addition to Se and organic photoconductor as examples of photosensitive members. However, it does not disclose problems peculiar to plasma CVD at all.

As the technology for element members used for electrophotographic photosensitive members, various materials are proposed including selenium, cadmium sulfide, zinc oxide, amorphous silicon, and organic compounds such as phthalocyanine. Particularly, a non-single-crystal deposited film containing silicon atoms as a main component which is represented by amorphous silicon, for example, an amorphous deposited film such as of amorphous silicon compensated by hydrogen and/or halogen (e.g., fluorine or chlorine) is proposed as a high-performance, high-durability and pollution-free photosensitive member and some types of amorphous deposited films are practically used. Japanese Patent Application Laid-Open No. 54-86341 discloses the technology for an electrophotographic photosensitive member in which a photoconductive layer is mainly formed of amorphous silicon.

Many methods for forming a non-single-crystal deposited film containing silicon atoms as a main component have been known so far, including the sputtering method, the method of decomposing a source gas by heat (thermal CVD method), the method of decomposing a source gas by light (optical CVD method), and the method of decomposing a source gas by plasma (plasma CVD method).

The plasma CVD method, that is, the method of forming a thin deposited film on a substrate by decomposing a source gas by DC, high-frequency, or microwave glow discharge is most suitable for a method of forming an amorphous-silicon deposited film for electrophotography and therefore, it is frequently practically used at present. Particularly, the plasma CVD method using microwave glow discharge decomposition, that is, the microwave plasma CVD method has been recently industrially noticed as a deposited-film forming method.

The microwave plasma CVD method has advantages of a high deposition rate and a high source-gas utilization efficiency in comparison with other methods. One of the microwave plasma CVD technologies making the most use of these advantages is disclosed in U.S. Pat. No. 4,504,518. The technology described in this patent makes it possible to obtain a high-quality deposited film at a high deposition rate and a low pressure of 0.1 Torr or less by the microwave plasma CVD method.

Moreover, the technology for improving the source-gas utilization efficiency by the microwave plasma CVD method is disclosed in Japanese Patent Application Laid-Open No. 60-186849. In short, the technology disclosed in it greatly improves the source-gas utilization efficiency by arranging a substrate so as to surround a microwave-energy introduction means and forming an internal chamber (that is, discharge space).

Furthermore, Japanese Patent Application Laid-Open No. 61-283116 discloses the improved microwave technology for fabricating a semiconductor member. That is, it discloses the technology for improving characteristics of a deposited film by providing an electrode (bias electrode) for controlling a plasma potential in a discharge space and depositing a film while applying a desired voltage (bias voltage) to the bias electrode and controlling the ion impact to the deposited film.

When using an aluminum-alloy cylinder as a substrate, the conventional method of manufacturing an electrophotographic photosensitive member in accordance with these prior technologies is specifically executed as shown below.

A substrate for the photosensitive member is worked so as to have a predetermined flatness by the diamond cutting using a lathe or milling machine according to necessity and then, cleaned with triethane. In some cases, the substrate is finished so as to have a predetermined or optional irregular surface in order to prevent interference.

Moreover, to form an irregular shape, a spherical trace dent is formed as shown below by using the apparatus shown in FIG. 8. As shown in FIG. 8, for example, a spherical trace dent 4 is formed by naturally dropping a rigid complete sphere 3 from a position higher by h than a surface 2 to make it collide with the surface 2. Moreover, it is possible to form a dent at a predetermined density in accordance with the hardnesses of the rigid complete sphere and metal surface as the occasion demands.

Thereafter, a deposited film mainly made of amorphous silicon serving as a photoconductive-member deposited film is formed on a substrate by the glow-discharge decomposition method. Then, an electrophotographic photosensitive member is manufactured by using the deposited film thus obtained.

However, abnormally grown portions are formed in a deposited film in the case of an electrophotographic photosensitive member manufactured in accordance with the prior technology and the portions become portions having no surface charge of a very small area. These phenomena particularly appear on an electrophotographic photosensitive member comprising a deposited film formed by the plasma CVD method like the case of amorphous silicon. However, the portions having no surface potential can be minimized by optimizing the surface-treatment, cleaning, and depositing conditions and no problem has practically occurred so far because of the degree of the resolving ability of development or lower.

Recently, however, (1) the resolution ability of development has been improved because it has been requested to make the picture quality of an electrophotographic device higher, and (2) as the operation speed of a copying machine has been accelerated and the electric charge condition has been severer, a portion having a surface with no potential has substantially greatly influenced peripheral potentials.

These very small portions having no electric charge have been pointed out as image defects though they have not been a problem in the prior art.

Moreover, these image defects have not practically been a large problem so far because a copy has been mainly used for a manuscript having only characters (so-called line copy).

However, as the picture quality of a copying machine has been improved in recent years, a manuscript including half tone such as a photograph has been frequently copied. Particularly, in the case of a color-copying machine having been recently spread, because these defects visually become more apparent, a photosensitive member having less abnormal growth is required.

Because these defects, i.e. specifically abnormally grown portions is very small, it is difficult to detect the presence of them even when the conductivity is measured by setting an electrode at the top. However, when an electrophotographic photosensitive member is subjected to charging, exposure and development in accordance with the electrophotographic process, particularly to form an uniform picture in half tone, even a slight potential difference on the surface of the electrophotographic photosensitive member appears as a visually-remarkable image defect. Particularly, in the case of an electrophotographic photosensitive member formed by the microwave plasma CVD method, the above problem frequently appears.

In the case of an electrophotographic photosensitive member formed by the plasma CVD method, the above image defect especially appears compared to an Se electrophotographic photosensitive member manufactured by vacuum deposition or an OPC electrophotographic photosensitive member manufactured by the blade coating method or dipping method.

Moreover, even in the case of a device like a solar cell manufactured by the same plasma CVD method, a delicate characteristic difference due to the position of a substrate does not influence its performance. Furthermore, in the case of a device that can be repaired by post-treatment, the above trouble does not occur.

Furthermore, the step of cleaning a substrate with triethane has no problem in the prior art. However, the step has been changed to the water-based cleaning step due to recent environmental problems and thereby because chlorine-based solvents cannot be easily used. However, when cleaning aluminum with water, a portion containing many impurities (e.g., Si) and locally exposed to the surface of the aluminum forms a local battery with peripheral normal aluminum to accelerate uncontrolled corrosion on the surface of a substrate.

SUMMARY OF THE INVENTION

It is an object of the present invention to provide a method of manufacturing an easily-usable electrophotographic photosensitive member which can be inexpensively and stably formed at a high speed and a high yield to prevent corrosion when a substrate is worked in order to solve the problems of the above conventional method of manufacturing an electrophotographic photosensitive member.

It is another object of the present invention to provide a method of manufacturing an electrophotographic photosensitive member which can solve the problem of an image defect that especially occurs in plasma CVD (chemical vapor deposition) and obtain a uniform high-quality image.

It is still another object of the present invention to provide a method of manufacturing a high-performance electrophotographic photosensitive member having fewer abnormally grown portions at a high yield.

It is still another object of the present invention to provide a method of manufacturing an electrophotographic photosensitive member, which comprises the steps of setting an aluminum substrate to a substrate holder and forming a functional film made of an amorphous material comprising silicon atoms as a matrix on the surface of the aluminum substrate by reduced-pressure vapor deposition, wherein the method further comprises a step of cleaning the surface of the substrate with water containing an inhibitor as a specific component before the step of forming the electrophotographic photosensitive member.

It is still another object of the present invention to provide a method of manufacturing an electrophotographic photosensitive member, which comprises the steps of setting an aluminum substrate to a substrate holder and forming a functional film made of an amorphous material comprising silicon atoms as a matrix on the surface of the aluminum substrate by reduced-pressure vapor deposition, wherein the method further comprises a step of forming irregularity comprising a plurality of spherical trace dents and degreasing the surface of the substrate with water containing an inhibitor as a specific component before the step of forming the electrophotographic photosensitive member.

It is still another object of the present invention to provide a method of manufacturing an electrophotographic photosensitive member, which comprises a step of forming a functional film made of an amorphous material comprising silicon atoms as a matrix on the surface of an aluminum substrate by reduced-pressure vapor deposition, wherein the method further comprises a step of forming a film having a thickness not less than 5 Å and not more than 150 Å containing aluminum, silicon and oxygen as main components in a composition ratio of aluminum:silicon:oxygen= a:b:c wherein when a=1, $0.1 \leqq b \leqq 1.0$ and $1 \leqq c \leqq 5$ by using water containing an inhibitor, before the step of forming the electrophotographic photosensitive member.

The above objects are achieved by the following means.

The present invention provides a method of manufacturing an electrophotographic photosensitive member, which comprises the steps of setting an aluminum substrate to a substrate holder and forming a functional film made of an amorphous material comprising silicon atoms as a matrix on the surface of the substrate by reduced-pressure vapor deposition, wherein a step of cleaning the substrate surface with water containing a specific-component inhibitor is conducted before the step of forming the electrophotographic photosensitive member. It is preferable to use a silicate as the specific inhibitor used in the cleaning step. It is preferable to use potassium silicate as the specific inhibitor used in the cleaning step. It is preferable that the specific inhibitor contained in the water containing the specific-component inhibitor used in the cleaning step has a concentration of not less than 0.05% and not more than 2%. It is preferable that the step of forming a functional film on the aluminum substrate includes a step of forming a deposited film of non-single-crystal comprising silicon atoms and either or both hydrogen atoms and fluorine atoms on an aluminum substrate by plasma CVD.

It is preferable that the aluminum substrate is an aluminum substrate having a total content of Fe+Si+Cu exceeding 0.01% by weight (wt. %) and not more than 1% by weight (wt. %), that the aluminum substrate is an aluminum substrate having an Fe content of not less than 10 ppm and not more than 1 wt. %, and that the aluminum substrate is an aluminum substrate having an Si content of not less than 10 ppm and not more than 1 wt. %. It is preferable that the aluminum substrate is an aluminum substrate having a Cu content not less than 10 ppm and not more than 1 wt. %.

Moreover, the present invention provides a method of manufacturing an electrophotographic photosensitive member, which comprises setting an aluminum substrate to a substrate holder and forming a functional film made of an amorphous material comprising silicon atoms as a matrix on the surface of the substrate by reduced-pressure vapor deposition, wherein degreasing of the substrate surface with the water containing a specific-component inhibitor and formation of irregularity comprising a plurality of spherical trace dents are conducted before the step of forming the electrophotographic photosensitive member. It is preferable that the irregularity is formed with dents having almost the same curvature and width.

Moreover, it is preferable that the curvature R and width D of the dents of the irregularity take values such that $0.035 \leqq D/R \leqq 0.5$ and it is preferable that each dent has a width of not less than 4 μm and not more than 500 μm. It is preferable to use silicate as the inhibitor for the step of forming the irregularity and it is preferable to use potassium silicate as the inhibitor for the step of forming the irregularity. After forming the irregularity comprising a plurality of spherical trace dents on the substrate surface, it is effective to clean the surface of the substrate with either of a surface-active agent, pure water, and water containing carbon dioxide dissolved therein and water containing a specific-component inhibitor, or a combination of two or more thereof. It is preferable that a drying step in cleaning after forming the irregularity comprising a plurality of spherical trace dents on the substrate surface is conducted by raising and drying the substrate surface with either of hot pure water, hot pure water containing carbon dioxide and hot pure water containing a specific-component inhibitor, or a combination of two or more thereof. Moreover, it is preferable that when forming the irregularity, the above aluminum substrate is an aluminum substrate having a total content of Fe+Si+Cu exceeding 0.01 wt. % and not more than 1 wt % and that the above aluminum substrate comprises Fe in the amount of 10 ppm or more and 1 wt % (or less). Moreover, it is possible that the aluminum substrate comprises Si in the amount of 10 ppm or more and 1 wt % or less, and that the above aluminum substrate comprises aluminum substrate containing Cu in the amount of 10 ppm or more and 1 wt % or less.

Furthermore, the present invention is a method of manufacturing an electrophotographic photosensitive member, which comprises the step of forming a functional film made of an amorphous material comprising silicon atoms as a matrix on the surface of an aluminum substrate by reduced-pressure vapor deposition, wherein the step of forming a film having a thickness in a range not less than 5 Å and not more than 150 Å and containing aluminum, silicon and oxygen as main components in a composition ratio of aluminum:silicon:oxygen=a:b:c provided that when a=1, b and c meet a range of $0.1 \leqq b \leqq 1.0$ and $1 \leqq c \leqq 5$, respectively, by using the water containing an inhibitor, before the step of forming the electrophotographic photosensitive member.

It is preferable that the inhibitor is a silicate and it is preferable that the inhibitor is potassium silicate.

It is preferable that the molar concentration of the inhibitor contained in the above water is kept in a range of 10° to $10^{-6}$ mol/l. It is preferable that the step of forming the functional film on the aluminum substrate includes the step of forming an amorphous deposited film comprising silicon atoms and at least one kind of hydrogen atoms and fluorine atoms on the aluminum substrate by plasma CVD. It is effective that the above water contains either of a surface-active agent and carbon dioxide, it is preferable that the substrate is cleaned with the above water at a pressure of 2 kg·f/cm$^2$ to 300 kg·f/2 cm2$^2$, and it is desirable to dry the substrate by raising it from hot water. It is preferable that the hot water is any one of hot pure water, hot water containing carbon dioxide, and hot water containing the inhibitor. It is preferable that the aluminum substrate comprising iron in the amount of 10 ppm or more and 1 wt. % or less, that the aluminum substrate comprises silicon in the amount of 10 ppm or more and 1 wt. % or less, and that the aluminum substrate comprises copper in the amount of 10 ppm or more and 1 wt. % or less. It is desirable that the total content of iron, silicon and copper of the aluminum substrate is kept in a range exceeding 0.01 wt. % and not more than 1 wt. %.

As the result of the study by the present inventor, the cause of an image defect generated when using an aluminum substrate is roughly divided into the following (A) and (B).

(A) Dust on a substrate or dirt in a cleaning water used for the cleaning or drying step is attached to become a core.

(B) A surface defect of a substrate becomes a core.

It is possible to prevent attachment of the dust or the like concerning the above (A) to a certain extent by making a place for handling a substrate such as a cutting and cleaning place clean, strictly cleaning a film-forming oven, and cleaning the surface of a substrate immediately before forming a deposited film. This purpose has been achieved so far by cleaning objects with a chlorine-based solvent such as trichloroethane. However, because the use of chlorine-based solvents has been recently restricted because they destroy the ozone layer, it is particularly necessary to study a cleaning method using water as a substitute means for a cleaning method using a chlorine-based solvent.

Moreover, it has been very difficult to reduce defects expressed in (B).

The present inventors have accomplished the present invention as the result of earnestly studying whether all these problems can be solved by combining aluminum containing a specific component with a specific cleaning method and combining aluminum containing a specific component with a specific surface roughing method.

As the result of the study by the present inventors, it is clarified that (B) is caused by the fact that high-hardness portions are locally present in aluminum and these high-hardness portions are gouged by the edge of a working machine when performing surface work such as cutting and pre-processing before forming a deposited film and surface defects are formed on the surface of an aluminum substrate.

To prevent these phenomena, it is usually preferable that less impurities are contained in aluminum. However, a oxide that is inevitably produced when melting aluminum of a very high purity in order to form the aluminum into a substrate shape is grown on the aluminum to cause the above defect. To prevent the problem, it is clarified that it is effective to contain Si atoms in the aluminum. Moreover, because a high-purity material is expensive from the viewpoint of the cost of a substrate, there is a sufficient room for study.

When performing cleaning by using a chlorine-based solvent such as trichloroethane after cutting the surface of a substrate, it is possible to completely prevent an image defect from occurring due to the surface property of a substrate only by performing the above cleaning.

However, it is recently not permitted to use the chlorine-based solvents because of environmental problems. Therefore, the present inventors also studied cleaning and surface roughing. As a result, it is found that aluminum is corroded due to water. Particularly, by soaking the aluminum containing silicon atoms in water to clean it, it is found that a local portion of the aluminum containing many Si atoms is remarkably corroded due to water. Moreover, it is found that corrosion occurs not only in a local portion containing many Si atoms but also a local portion containing many Fe and Cu atoms.

The above phenomenon becomes more noticeable as the water temperature rises and moreover, it becomes especially noticeable when aluminum contains not only Si, Fe and Cu atoms but also magnesium in order to improve the cutting characteristic. To prevent aluminum from corroding, various types of corrosion inhibitors are proposed. However, when using an aluminum substrate containing Si, Fe and Cu for an electrophotographic photosensitive member like the case of the present invention, even a small number of defects produced on the substrate having a large area becomes a problem. Further, since the effect is insufficient or these corrosion inhibitors may disadvantageously affect the formation of a functional film after cleaning and surface-roughening, use of conventional corrosion inhibitors is restricted.

However, the present inventors earnestly studied whether it was possible to prevent generation of the above defects by adding a corrosion inhibitor to the water for cleaning used in the step of working the substrate before the step of depositing a functional film on the substrate and forming a film not affecting a functional film to be formed later. As a result, the present inventors have arrived at the present invention.

Though many points are not clarified yet on the mechanism of the present invention, the present inventors believe the following at present.

A portion containing many Si, Fe and Cu atoms and locally exposed to the surface of aluminum forms a local battery with surrounding normal aluminum, whereby corrosion is accelerated under water.

However, because potassium silicate added to the water for cleaning or added to a surface-roughing solution forms an Al—Si—O film on the aluminum surface while being cleaned or roughed, corrosion is effectively prevented without any action for accelerating corrosion by formation of a local battery. Moreover, by attaching the Al—Si—O film, defects are not formed on the substrate surface. Therefore, it is possible to prevent abnormal growth (defects) when forming a functional film.

Moreover, the electrophotographic characteristic is improved as an unexpected advantage of the present invention.

When forming, for example, an amorphous-silicon deposited film on a substrate by plasma CVD, it can be considered that the reaction is classified into three stages such as the decomposition stage of the source gas in vapor phase, the transport stage of the active species from discharge space to a substrate surface, and the surface reaction stage on the substrate surface. Particularly, the surface reaction stage greatly influences the structure of an obtained deposited film. Moreover, the surface reaction is greatly influenced by the temperature, material quality and shape of a substrate surface, and adsorbed matter of a substrate surface.

Particularly, for a high-purity aluminum substrate, the water adsorption state on the substrate surface locally differs in the case of only cleaning the substrate with a nonaqueous solvent such as trichloroethane, in the case of only surface-roughing the substrate with a nonaqueous solvent after it is cut, or in the case of only cleaning the substrate with pure water without performing other type of cleaning after it is cut. When forming a deposited film containing silicon atoms and hydrogen atoms and/or fluorine atoms like an amorphous silicon film on a substrate having the above surface state by plasma CVD, the reaction of the surface is greatly influenced by the amount of molecules of water remaining on the substrate surface. Thereby, the composition and structure of the interface of the deposited film with the substrate are changed due to the amount of water adsorbed at the position of the substrate and resultantly, the injection property of electric charges from the substrate at the portion is changed in the step of the electrophotographic process and a surface-potential difference appears.

In the case of the present invention, by forming a uniform Al—Si—O film on the surface of a substrate with a silicate before forming a functional film by plasma CVD, it is possible to form an interface capable of smoothly exchanging electric charges when forming a deposited film. Therefore, it is possible to improve the electrophotographic characteristic including the improvement of charging and reduction of light sensitivity.

The present invention makes it possible to obtain the above advantage by a novel method of completely removing the fat and halogen-based remainder preventing the advantages of the present invention with a surface-active agent by cleaning or surface roughing and moreover, attaching a film capable of preventing corrosion to the surface of a substrate with a silicate.

The present invention treats a substrate in the sequence of the degreasing-cleaning step the, rinsing step and the drying step before the film-forming step on the cut substrate. In the degreasing-cleaning step, a high-quality aluminum substrate having an amorphous deposited film is obtained by using a water-based cleaning agent containing a surface-active agent to thereby remove residues such as fat and halide on the substrate and moreover adding a silicate to thereby attach a film capable of preventing corrosion to the surface of the aluminum substrate.

A procedure for actually forming an electrophotographic photosensitive member by a method of the present invention of manufacturing an electrophotographic photosensitive member by using a cylinder made of an aluminum alloy as a substrate is described below by using a substrate cleaner of the present invention shown in FIG. 1 and a deposited-film forming apparatus shown in FIG. 3.

A diamond bite (trade name: Miracle bite) made by TOKYO DIAMOND, is set to an air-damper-provided lathe for precision cutting (made by PNEUMO PRECLSION INC.) so as to obtain a face angle of 5° from a cylinder central angle. Then, a substrate is vacuum-chucked to the rotary flange of the lathe and mirror-cutting is applied to the substrate at a circumferential speed of 1,000 m/min and a feed rate of 0.01 mm/R so that the outside diameter of the substrate becomes 108 mm while spraying refined kerosene through an attached nozzle and at the same time sucking cutting chips through an attached vacuum nozzle.

FIG. 1 is a schematic block diagram of the cleaner.

The cut substrate is cleaned by the cleaner as shown in FIG. 1. The substrate cleaner as shown in FIG. 1 has a treating section 102 and a substrate carrying mechanism 103. The treating section 102 has a substrate mounting table 111, a substrate cleaning bath 121, a rinsing bath 131, a drying bath 141, and a substrate conveying-out table 151. The substrate cleaning bath 121, the rinsing bath 131 and the drying bath 141 are respectively provided with a thermoregulator (not illustrated) for keeping the temperature of a solution constant. The carrying mechanism 103 has a carrying rail 165 and a carrying arm 161. The carrying arm 161 has a moving mechanism 162 for moving on the rail 165, a chucking mechanism 163 for chucking the substrate 101, and an air cylinder 164 for vertically moving the chucking mechanism 163.

The substrate 101 set on the mounting table 111 after cutting is carried to the cleaning bath 121 by the carrying mechanism 103. The substrate 101 is ultrasonic-treated in a surface-active agent or surface-active agent 122 containing a silicate in the cleaning bath 121 and thereby dust and fat attached to the surface of the substrate are removed.

Then, the substrate 101 is carried to the rinsing bath 131 by the carrying mechanism 103, and kept at a temperature of 25° C. and further rinsed with pure water or the like. The pure water or the like is constantly controlled so as to be constant by an industrial conductivity meter (trade name: α900R/C, made by HORIBA SEISAKUSHO). Then, the substrate 101 is carried to the drying bath 141 containing hot pure water or the like by the carrying mechanism 103, and kept at a temperature of 60° C. and further raised by an elevating apparatus (not illustrated) for drying. The hot demineralized water or the like is controlled so as to be constant by an industrial conductivity meter (trade name: α900R/C, made by HORIBA SEISAKUSHO).

The substrate 101 finishing the drying step is carried to the conveying-out table 151 by the carrying mechanism 103.

The cleaned substrate may be roughed into a predetermined shape or an optional shape in order to prevent an interference fringe.

Then, a deposited film mainly containing amorphous silicon is formed on the cleaned substrate by an apparatus for forming a deposited film for a photoconductive member by using the plasma CVD method, as shown in FIG. 3.

In FIG. 3, a reaction vessel 301 is constituted with a base plate 304, a wall 302 also serving as a cathode electrode, and a top plate 303. In the reaction vessel 301, a substrate 306 on which a deposited film of amorphous silicon is formed is set to the central portion of the cathode electrode 302 and also serves as an anode electrode.

To form a deposited film of amorphous silicon on the substrate 306 by the deposited-film forming apparatus, a source-gas taking-in valve 311 is closed and an exhaust valve 314 is opened to exhaust the reaction vessel 301. When the reading of a vacuum gauge (not illustrated) indicates approx. $5\times10^{-6}$ Torr, the source-gas taking-in valve 311 is opened. Taken-in gas is adjusted to a predetermined flow rate by a mass-flow controller 312. For example, a source gas such as $SiH_4$ gas is taken into the reaction vessel 301. Then, after confirming that the surface temperature of the substrate 306 is set to a predetermined value by a heater 308, a high-frequency power supply (frequency: 13.56 MHz) 316 is set to a desired power to generate a glow discharge in the reaction vessel 301.

Moreover, while a deposited film is formed, the substrate 306 is rotated at a certain speed by a motor (not illustrated) in order to form a uniform deposited film. Thus, it is possible to form an amorphous-silicon deposited film on the substrate 306.

In the present invention, it is possible to use a substrate having a surface made flat by treating surface irregularity, a mirror-finished surface, a non-mirror-finished surface for preventing an interference fringe, or a surface provided with a desired-shape irregularity.

In the case of the present invention, a portion locally exposed to the surface of aluminum and having many Si, Fe, and Cu atoms forms a local battery with a circumferential normal aluminum portion and thereby, corrosion is accelerated particularly due to pure water or the like. Therefore, to form a film by adding a silicate, it is necessary that the film is formed before a substrate contacts pure water or the like. Moreover, a film of the present invention is formed at a relatively early stage. Therefore, formation of a film while being cleaned with pure water or the like is also effective in the case of the present invention. That is, there are a method of dissolving a silicate in a surface-active agent in a substrate cleaning bath for degreasing and cleaning after cutting and a method of dissolving a silicate in pure water or the like in a rinsing bath, and both methods are suitable for the present invention.

Moreover, when the above film is formed, it is effective in the case of the present invention to clean the film in a rinsing bath or a drying bath immediately after forming the film with either of the pure water, the water containing carbon dioxide and the water containing a silicate, or combination of two or more thereof.

Though any one of phosphate, silicate and borate can be used as the inhibitor for the present invention, a silicate is most suitable for the present invention.

Moreover, though potassium silicate and sodium silicate can be used as a silicate, potassium silicate is more suitable for the present invention.

Any one of an anionic surface-active agent, cationic surface-active agent, nonionic surface-active agent, ampholytic surface-active agent, and mixture of them can be used as the surface-active agent used for the cleaning step of the present invention. Particularly, an anionic surface-active agent such as a carboxylate, a sulfonate, a sulfate ester, or a phosphate ester or a nonionic surface-active agent such as fatty acid ester is effective for the present invention.

In the case of the present invention, to perform cleaning or surface roughing, it is preferable to use a water-based method using a surface-active agent or a surface-active agent containing a silicate. In this case, it is possible to optionally select the quality of the water before dissolving a surface-active agent and a silicate in it. However, it is preferable to use pure water at a semiconductor grade, and especially to use extrapure water at a VLSI grade. Specifically, as the resistivity at a water temperature of 25° C., a lower limit of 1 MΩ·cm or more, more preferably a lower limit of 3 MΩ·cm or more, or most preferably a lower limit of 5 MΩ·cm or more is suitable for the present invention. Though the upper limit of the resistivity can be any value up to a logical resistivity (18.25 MΩ·cm), an upper limit of 17 MΩ·cm or less, more preferably an upper limit of 15 MΩ·cm or less, or most preferably an upper limit of 13 MΩ·cm or less is suitable for the present invention from the viewpoints of cost and productivity. As the number of particles, 10,000 or less of particles with a size of 0.2 μm or more in 1 ml, more preferably 1,000 or less of the particles in 1 ml, or most preferably 100 or less of the particles in 1 ml is suitable for the present invention. As the number of microorganisms, a total count of 100 or less in 1 ml, more preferably a total count of 10 or less in 1 ml, or most preferably a total count of 1 or less in 1 ml is suitable for the present invention. As a total organic content (TOC), 10 mg or less in 1 liter, more preferably 1 mg or less in 1 liter, or most preferably 0.2 mg or less in 1 liter is suitable for the present invention.

To obtain the water having the above quality, there are the activated carbon method, the distillation method, the ion exchange method, the filtering method, the reverse osmosis method, and the ultraviolet sterilization method. However, it is preferable to use these methods by combining them and thereby improving the water quality to a requested level.

In the case of the present invention, if the concentration of the silicate contained in water when performing cleaning together with film formation is too high, a blot due to liquid trace occurs which may cause a deposited film to be peeled off. However, if the concentration is too low, the degreasing effect and film-forming effect are diminished and advantages of the present invention may not be completely obtained. Therefore, as the range of the molar concentration of the silicate contained in water, a range of $10^{-6}$ to $10^{0}$, more preferably a range of $10^{-5}$ to $10^{-1}$, or most preferably a range of $10^{-2}$ to $10^{-4}$ is suitable for the present invention.

In the case of the present invention, if the concentration of the silicate contained in the water containing a surface-active agent when performing cleaning or surface roughening is too high, a blot due to liquid trace occurs which may cause a deposited film to be peeled off. However, if the concentration is too low, the degreasing effect and film-forming effect are diminished and thus it may be impossible to completely obtain advantages of the present invention.

Therefore, as the concentration of silicate contained in the water containing a surface-active agent, a range of 0.05 to 2% both inclusive, more preferably a range of 0.1 to 1.5% both inclusive, or most preferably a range of 0.2 to 1% both inclusive is suitable for the present invention.

Therefore, as the weight percent of a surface-active agent containing a silicate in a water-based cleaning agent, a range of 0.1 to 20 wt. % both inclusive, preferably a range of 1 to 10 wt. % both inclusive, or most preferably a range of 2 to 8 wt. % both inclusive is suitable for the present invention.

If the temperature of the water of the surface-active agent or the surface-active agent containing a silicate for cleaning of the present invention is too high, a blot due to liquid trace occurs which may cause a deposited film to be peeled off. However, if the temperature is too low, the degreasing effect and film-forming effect are diminished and thereby it may be impossible to completely obtain advantages of the present invention. Therefore, the water temperature, should be in a range of 10 to 90° C. both inclusive, more preferably a range of 15 to 70° C. both inclusive, most preferably a range of 20 to 60° C. both inclusive.

If the pH of a surface-active agent containing a silicate when performing cleaning or surface roughing is too high, a blot due to liquid trace occurs which may cause a deposited film to be peeled off. However, if the pH is too low, the degreasing effect and film-forming effect are diminished and it may be impossible to completely obtain advantages of the present invention.

Therefore, as the pH of a surface-active agent containing silicate, a range of 8 to 12.5 both inclusive, more preferably a range of 9 to 12 both inclusive, or most preferably a range of 10 to 11.5 both inclusive is suitable for the present invention.

In the case of the present invention, if the thickness of a film formed on an aluminum substrate is too small, the effect does not appear. However, if the thickness is too large, the conductivity between the film and the aluminum substrate may be lowered thereby causing damage. Therefore, as the thickness of the film, a range of 5 to 150 Å both inclusive, more preferably a range of 10 to 130 Å both inclusive, or most preferably a range of 15 to 120 Å both inclusive is suitable for the present invention.

In the case of the present invention, if the amount of Si and O components is too small as the composition ratio of an Al—Si—O film formed on an aluminum substrate, Al component relatively increases and thereby the film cannot completely show its performance. However, if the amount of Si and O components is too large, the film also may not be suitable because the conductivity decreases. When assuming Al content as 1, an Si content of 0.1 to 1.0 both inclusive, more preferably an Si content of 0.15 to 0.8 both inclusive, or most preferably an Si content of 0.2 to 0.6 both inclusive is suitable for the present invention. Moreover, when assuming Al content as 1, an O content of 1 to 5 both inclusive, more preferably an O content of 1.5 to 4 both inclusive, or most preferably an O content of 2 to 3.5 both inclusive is suitable for the present invention.

It is effective to use an ultrasonic wave in the cleaning step or the cleaning step after the surface-roughening step in order to show the advantages of the present invention. As the frequency of ultrasonic wave, preferably a range of 100 Hz to 10 MHz both inclusive, more preferably a range of 1 kHz to 5 MHz both inclusive, or most preferably a range of 10 to 100 kHz both inclusive is effective. As the output of ultrasonic wave, preferably a range of 0.1 W/liter to 1 kW/liter both inclusive or preferably a range of 1 W/liter to 100 W/liter both inclusive is effective.

The quality of the water containing carbon dioxide to be used in the cleaning step, the cleaning step after surface roughening, the rinsing step, or the drying step is very important. Before carbon dioxide is dissolved, it is preferable that the water is pure at a semiconductor grade, particularly extrapure water at a VLSI grade is preferable. Specifically, as the resistivity at a water temperature of 25° C., a lower limit of 1 MΩ·cm or more, more preferably a lower limit of 3 MΩ·cm or more, or most preferably a lower limit of 5 MΩ·cm or more is suitable for the present invention. Though the upper limit of the resistivity can be any value up to a logical resistivity (18.25 MΩ·cm), an upper limit of 17 MΩ·cm or less, more preferably an upper limit of 15 MΩ·cm or less, or most preferably an upper limit of 13 MΩ·cm or less is suitable for the present invention from the viewpoints of cost and productivity. As the number of particles, 10,000 or less with a size of 0.2 μm or more in 1 ml, more preferably 1,000 or less in 1 ml, or most preferably 100 or less in 1 ml is suitable for the present invention. As the number of microorganisms, a total count of 100 or less in 1 ml, more preferably a total count of 10 or less in 1 ml, or most preferably a total count of 1 or less in 1 ml is suitable for the present invention. As a total organic content (TOC), 10 mg or less in 1 liter, more preferably 1 mg or less in 1 liter, or most preferably 0.2 mg or less in 1 liter is suitable for the present invention.

To obtain the water having the above quality, there are the activated carbon method, the distillation method, the ion exchange method, the filtering method, the reverse osmosis method, and the ultraviolet sterilization method. However, it is preferable to use these methods by combining them and thereby improving the water quality to a requested level.

In the case of the present invention, the amount of carbon dioxide to be dissolved in the above types of water can be any value up to a saturated solubility. However, if the amount of carbon dioxide is too large, bubbles are generated when water temperature fluctuates and are attached to the surface of a substrate, whereby a spot-shaped blot may occur. Moreover, if the amount of dissolved carbon dioxide is too large, the pH decreases and thereby the substrate may be damaged. However, if the amount of dissolved carbon dioxide is too small, it is impossible to obtain advantages of the present invention.

Therefore, it is necessary to optimize the amount of carbon dioxide to be dissolved in accordance with the situation while considering the quality requested for a substrate.

In general, a preferable amount of dissolved carbon dioxide according to the present invention is 60% or less with respect to a saturated solubility thereof, preferably 40% with respect to a saturated solubility thereof.

In the case of the present invention, it is practical to control the amount of dissolved carbon dioxide with the conductivity or pH of water. However, when controlling the amount of dissolved carbon dioxide with the conductivity, the present invention shows a pronounced effect at a preferable conductivity range of 2 to 40 μS/cm both inclusive, more preferably a conductivity range of 4 to 30 μS/cm both inclusive, or most preferably a conductivity range of 6 to 25 μS/cm both inclusive. When controlling the amount of dissolved carbon dioxide with the pH, the present invention shows a pronounced effect at a preferable pH range of 3.8 to 6.0 both inclusive or more preferably a pH range of 4.0 to 5.0 both inclusive. The conductivity is measured with a conductivity meter and a value converted into 25° C. by temperature correction is used as the value of the conductivity.

As the temperature of the water for cleaning or rinsing, a range of 5 to 90° C. both inclusive, more preferably a range of 10 to 55° C. both inclusive, or most preferably a range of 15 to 40° C. both inclusive is suitable for the present invention.

The method of dissolving carbon dioxide in water can be according to bubbling or a method using a diaphragm. In the case of the present invention, it is important to use the water containing carbon dioxide. When using a carbonate such as sodium carbonate in order to obtain carbonic-acid ions, positive ions such as sodium ions impede advantages of the present invention.

To clean the surface of a substrate with the thus-obtained water containing carbon dioxide, there is a method of dipping and a method of spraying pressurized water on the substrate surface.

In the case of the method of cleaning the substrate by dipping, it is basic to dip a substrate in a water bath containing the water containing carbon dioxide. In this case, the present invention becomes more advantageous by combining dipping with ultrasonic save, circulating water, or introducing air to perform bubbling.

When spraying water on the surface of a substrate, if the water pressure is too low, advantages of the present invention are diminished. However, if the water pressure is too high, a pear-skin pattern occurs on the picture of an obtained electrophotographic photosensitive member, particularly on a half-tone picture. Therefore, as the water pressure, a range of 2 to 300 kg·f/cm$^2$ both inclusive, more preferably a range of 10 to 200 kg·f/cm$^2$ both inclusive, most preferably a range of 20 to 150 kg·f/cm$^2$ both inclusive is suitable for the present invention. However, the pressure unit kg·f/cm$^2$ in the present invention represents kilogram-force per square centimeter, and 1 kg·f/cm$^2$ is equal to 98066.5 Pa.

The water spraying method includes spraying high-pressure water through a nozzle by a pump or a method of mixing the water drawn by a pump with high-pressure air before a nozzle, and spraying the water by the air pressure.

As the flow rate of water, a range of 1 to 200 liter/min per substrate both inclusive, more preferably a range of 2 to 100 liter/min per substrate both inclusive, or most preferably a range of 5 to 50 liter/min per substrate both inclusive is suitable for the present invention from the viewpoints of the advantages and cost.

As the cleaning time by the water containing carbon dioxide, a range of 10 sec to 30 min both inclusive, more preferably a range of 20 sec to 20 min both inclusive, or most preferably a range of 30 sec to 10 min both inclusive is suitable for the present invention.

As the hot water temperature in the drying step, a range of 30 to 90° C. both inclusive, more preferably a range of 35 to 80° C. both inclusive, or most preferably a range of 40 to 70° C. both inclusive is suitable for the present invention.

The lifting rate for performing lifting-drying is very important and a preferable range of 100 to 2,000 mm/min both inclusive, more preferably a range of 100 to 200 mm/min both inclusive, or most preferably a range of 300 to 1,000 mm/min both inclusive is suitable for the present invention.

If the time from cleaning with the water containing carbon dioxide up to inputting to a deposited-film forming apparatus is too long, advantages of the present invention are diminished. However, if the time is too short, advantages of the present invention are not stabilized. Therefore, as the time, a range of 1 min to 8 hr both inclusive, more preferably a range of 2 min to 4 hr both inclusive, or most preferably a range of 3 min to 2 hr both inclusive is suitable for the present invention.

In the case of the present invention, it is also possible to add a silicate to either of the rinsing step and the drying step. As described above, if the concentration of the water containing a silicate is too high, a blot due to liquid trace occurs and cause a deposited film to be peeled off. If the concentration is too low, the degreasing effect and film-forming effect are diminished and it may be impossible to completely obtain advantages of the present invention. Therefore, as the molar concentration of the silicate contained in water, a range of $10^0$ to $10^{-6}$ molar both inclusive, more preferably a range of $10^{-1}$ to $10^{-5}$ molar both inclusive, or most preferably a range of $10^{-2}$ to $10^{-4}$ molar both inclusive is suitable for the present invention.

Moreover, it is possible to treat the surface of a cut substrate by a substrate-surface roughing machine (FIG. 7). The substrate-surface roughing machine shown in FIG. 7 has a solution tank 76, a barrel 72 made of a metallic net, a rigid complete sphere 73, a treating-solution spray nozzle 74, and a shower nozzle 75.

The substrate 71 set in the barrel 72 after cutting is rotated at a speed of approx. 30 rpm by a motor (not illustrated) together with the barrel 72. In this case, the rigid complete spheres 73 are raised by a plate set in the barrel 72 to the upper side in the rotational direction. The raised rigid complete spheres 73 are naturally dropped and propelled in the direction of the substrate 71 by a treating solution having a pressure of approx. 1 kg/cm$^2$ supplied from the treating-solution spray nozzle 74. The propelled rigid complete spheres 73 collide with the substrate 71 to form an irregularity on the substrate 71. It is possible to optionally set the size and depth of the irregularity in accordance with the rotational speed, the treating-solution spraying pressure, the size of the rigid complete sphere, or the distance to the substrate.

The surface-roughed substrate 71 is washed with the pure water sprayed from the shower nozzle 75. Thereafter, the substrate 71 can be dried by a hot-air mechanism (not illustrated). However, as a cleaning method of the present invention after surface roughing, it is preferable to use the cleaner as shown in FIG. 1.

The present invention makes it possible to prevent the above interference fringe by adjusting the curvature R and width D of a spherical trace dent formed on the substrate surface.

That is, when using a surface-treated metallic body of the present invention as a substrate, by setting D/R to 0.035 or more, 0.5 Newton's rings or more due to senior ring interference are present in each trace dent and by setting D/R to 0.055 or more, one Newton's ring or more are present. Thus, it is possible to distribute all interference fringes of an electrophotographic photosensitive member to each trace dent and thereby prevent interference fringes. Moreover, as the width D of a trace dent, a range of 4 to 500 $\mu$m both inclusive is preferable for the present invention. Furthermore, it is preferable for the present invention to set the width D to a value equal to or less than a light irradiation spot diameter. Particularly, when using a laser beam, it is preferable to set the width D to a value equal to or less than the resolving ability.

The width D and the curvature R are shown in FIG. 8 and the width D of a dent formed on the substrate 1 can be controlled by controlling a height h from the surface 2 of the substrate 1 for dropping the sphere 3 onto the substrate 1. FIG. 8 shows that the sphere 3 drops in the direction of an arrow 5 from a slot 6.

In the case of the present invention, the material of a substrate can use any material as long as the material uses aluminum as a matrix.

It is suitable for the present invention that an aluminum substrate contains Fe of 10 ppm or more, Si of 10 ppm or more, and Cu of 10 ppm or more, and that the total content of Fe+Si+Cu contains more than 0.01 wt. % and not more than 1 wt. %.

Moreover, it is preferable that the substrate contains Fe, Si and Cu of 1 wt. % or less, respectively.

In the case of the present invention, it is effective that the substrate contains magnesium in order to improve the workability of the substrate. As the content of magnesium, a preferable range is 0.1 to 10 wt. % both inclusive or more preferable range is 0.2 to 5 wt. % both inclusive.

Moreover, in the case of the present invention, it is effective that aluminum contains any of the substances H, Li, Na, K, Be, Ca, Ti, Cr, Mn, Fe, Co, Ni, Cu, Ag, Zn, Cd, Hg, B, Ca, In, C, Si, Ge, Sn, N, P, As, O, S, Se, F, Cl, Br, and I.

In the case of the present invention, a substrate is formed into a desired shape. For example, for electrophotographic use, an endless-belt-like substrate or the above cylindrical substrate is the most suitable for the present invention in the case of a continuous high-speed copying machine. Though the cylindrical substrate is not restricted in size, it is practically preferable that it has a diameter of 20 to 500 mm both inclusive and a length of 10 to 1,000 mm both inclusive. The thickness of a support is determined so that a desired photoconductive member can be formed. When a photoconductive member is requested, the thickness of the member is minimized as long as the function as a support can be completely shown. Also in this case, however, the thickness is generally set to 10 $\mu$m or more from the viewpoints of manufacturing and handling the support and moreover from the viewpoint of the mechanical strength.

A photosensitive member used in the present invention may be any one of an amorphous-silicon photosensitive member, selenium photosensitive member, cadmium-sulfide photosensitive member, and organic photosensitive member. Particularly, however, a non-single-crystal photosensitive member containing silicon such as an amorphous-silicon photosensitive member shows a noticeable effect.

In the case of the non-single-crystal photosensitive member containing silicon, a source gas used for forming a deposited film includes an amorphous-silicon-forming source gas such as silane ($SiH_4$), disilane ($Si_2H_6$), silicon tetrafluoride ($SiF_4$), or disilicon hexafluoride ($Si_2F_6$), or a mixed gas of these substances.

Dilute gases include hydrogen ($H_2$), argon (Ar), or helium (He).

Moreover, characteristic improvement gases for changing bandgap widths of a deposited film include a gas containing nitrogen atoms such as nitrogen ($N_2$) or ammonia ($NH_3$), a gas containing oxygen atoms such as oxygen ($O_2$), nitrogen monoxide (NO), nitrogen dioxide ($NO_2$), dinitrogen oxide ($N_2O$), carbon monoxide (CO), or carbon dioxide ($CO_2$), a hydrocarbon gas such as methane ($CH_4$), ethane ($C_2H_6$), ethylene ($C_2H_4$), acetylene ($C_2H_2$), or propane ($C_3H_8$), and a fluorine compound gas such as germanium tetrafluoride ($GeF_4$) or nitrogen fluoride ($NF_3$), and a mixed gas of these substances.

Moreover, the present invention is still effective for simultaneously introducing a dopant gas such as diborane ($B_2H_6$), fluoborate ($BF_3$), or phosphine ($PH_3$) into a discharge space for doping.

In the case of an electrophotographic photosensitive member of the present invention, the total thickness of a deposited film on a substrate can be set to any value. However, a particularly preferable image can be obtained from an electrophotographic photosensitive member in a total-thickness range of 5 to 100 $\mu$m both inclusive, more preferably 10 to 70 $\mu$m both inclusive, or most preferably 15 to 50 $\mu$m both inclusive.

In the case of the present invention, the effect of the pressure of a discharge space while a deposited film is deposited is recognized in any region. Specifically, preferable discharge stability and deposited-film uniformity are well reproduced in a range of 0.5 to 100 mTorr both inclusive or more preferably in a range of 1 to 50 mTorr both inclusive.

In the case of the present invention, the substrate temperature of a deposited film while being deposited is effective in a range of 100 to 500° C. both inclusive. Specifically, an extreme effect is confirmed in a range of 150 to 450° C. both inclusive, more preferably in a range of 200 to 400° C. both inclusive, or most preferably in a range of 250 to 350° C. both inclusive.

In the case of the present invention, it is possible to use any heating unit as the means for heating a substrate as long as it conforms to vacuum specifications. More specifically, substrate-heating units include an electric-resistance-heating unit such as a sheath-like-heater wound heater, a flat heater or a ceramics heater, a heat-radiation-lamp heating unit such as a halogen lamp or an infrared lamp, and a heating unit according to the heat exchange means using liquid or gas as a temperature medium. As the surface material of heating means, it is possible to use a metal such as stainless steel, nickel, aluminum, or copper, or ceramics, or heat-resistant polymeric resin. Moreover, it is possible to use a vessel dedicated to heating in addition to a reaction vessel, heat it, and then carry a substrate into the reaction vessel under a vacuum state. The present invention makes it possible to use the above means alone or in combination.

In the case of the present invention, as the energy for generating plasma, any one of DC, RF and microwave can be used. Specifically, when using microwaves as the energy for generating plasma, abnormal deposition due to a surface defect of a substrate appears, microwaves are absorbed in adsorbed moisture, and interface change becomes more pronounced. Therefore, advantages of the present invention become more noticeable.

In the case of the present invention, when using microwaves to generate plasma, any microwave power can be used as long as the power can generate discharge. However, a power range of 100 W to 10 kW both inclusive or more preferably, a power range of 500 W to 4 kW both inclusive is proper to embody the present invention.

In the case of the present invention, it is effective to apply a voltage (bias voltage) to a discharge space while a deposited film is formed, and it is preferable that an electric field is applied at least in the direction in which positive ions collide with a substrate. It is preferable to apply a bias voltage in which a DC-component voltage ranges between 1 and 500 V both inclusive, more preferably between 5 and 100 V both inclusive while a deposited film is formed in order to obtain advantages of the present invention.

In the case of the present invention, when introducing microwaves into a reaction vessel by using a dielectric window, as a material for the dielectric window, a material for minimizing damage of microwaves such as alumina ($Al_2O_3$), aluminum nitride (AlN), boron nitride (BN), silicon nitride (SiN), silicon carbide (SiC), silicon oxide ($Si_2$), beryllium oxide (BeO), Teflon, or polystyrene are generally used.

In the case of a method of forming a deposited film having a structure surrounding a discharge space with a plurality of substrates, an interval of 1 to 50 mm both inclusive between adjacent substrates is preferable. It is possible to use any number of substrates as long as the substrates can form a discharge space. However, it is proper to use three substrates or more, preferably 4 substrates or more.

The present invention can be applied to any method of manufacturing an electrophotographic photosensitive member. Particularly, the present invention is very effective when forming a deposited film by setting substrates so as to surround a discharge space and introducing microwaves by a waveguide from at least one end of the substrates.

An electrophotographic photosensitive member manufactured by the method of the present invention can be used not only for an electrophotographic copying machine but also in the electrophotography applied field and machines including a laser-beam printer, CRT printer, LED printer, liquid-crystal printer, and laser plate-making machine.

DETAILED DESCRIPTION OF THE PREFERRED EMBODIMENTS

Advantages of the present invention are specifically described below in experiments. However, the present invention is not restricted by these experiments.

<Experiment A1>

The surface of a cylindrical substrate made of aluminum containing 0.05 wt. % of Si, 0.03 wt. % of Fe, and 0.01 wt. % of Cu and having a diameter of 108 mm, a length of 358 mm, and a thickness of 5 mm was cut in accordance with the same procedure as an example of manufacturing an electrophotographic photosensitive member.

Figure 1:
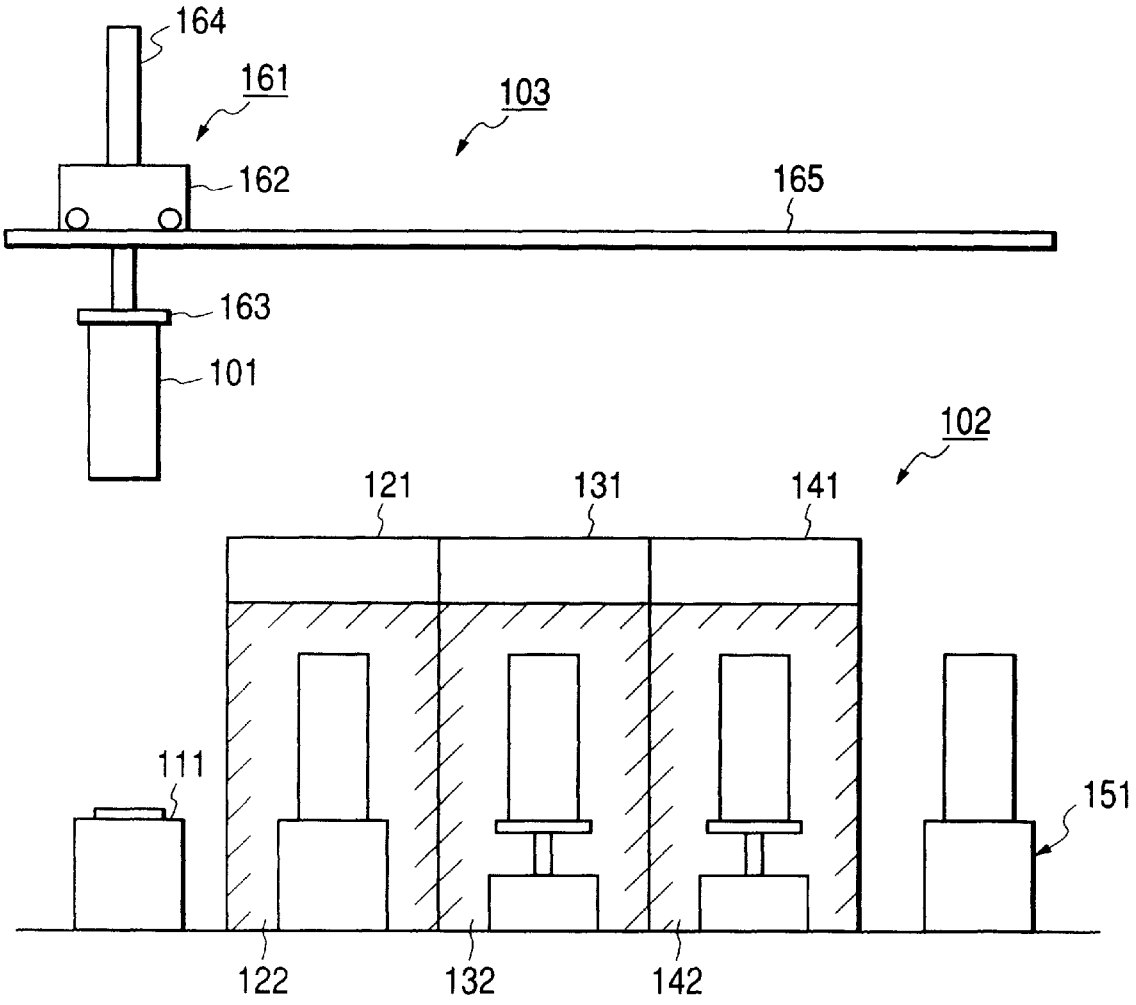
FIGS. 1 and 2 are schematic block diagrams showing one example of the cleaner.

When 15 min passed after completing the cutting step, degreasing was performed with a detergent (nonionic surface-active agent) and then rinsing and drying were performed in accordance with the conditions shown in Table 1 by the surface treating apparatus of the present invention shown in FIG. 1. In this case, as shown in Table 3, baths for storing an inhibitor were changed. (The inhibitor was added to a surface-active-agent aqueous solution at 3 g/l by using potassium silicate so that pH became 11.0.)

Figure 3:
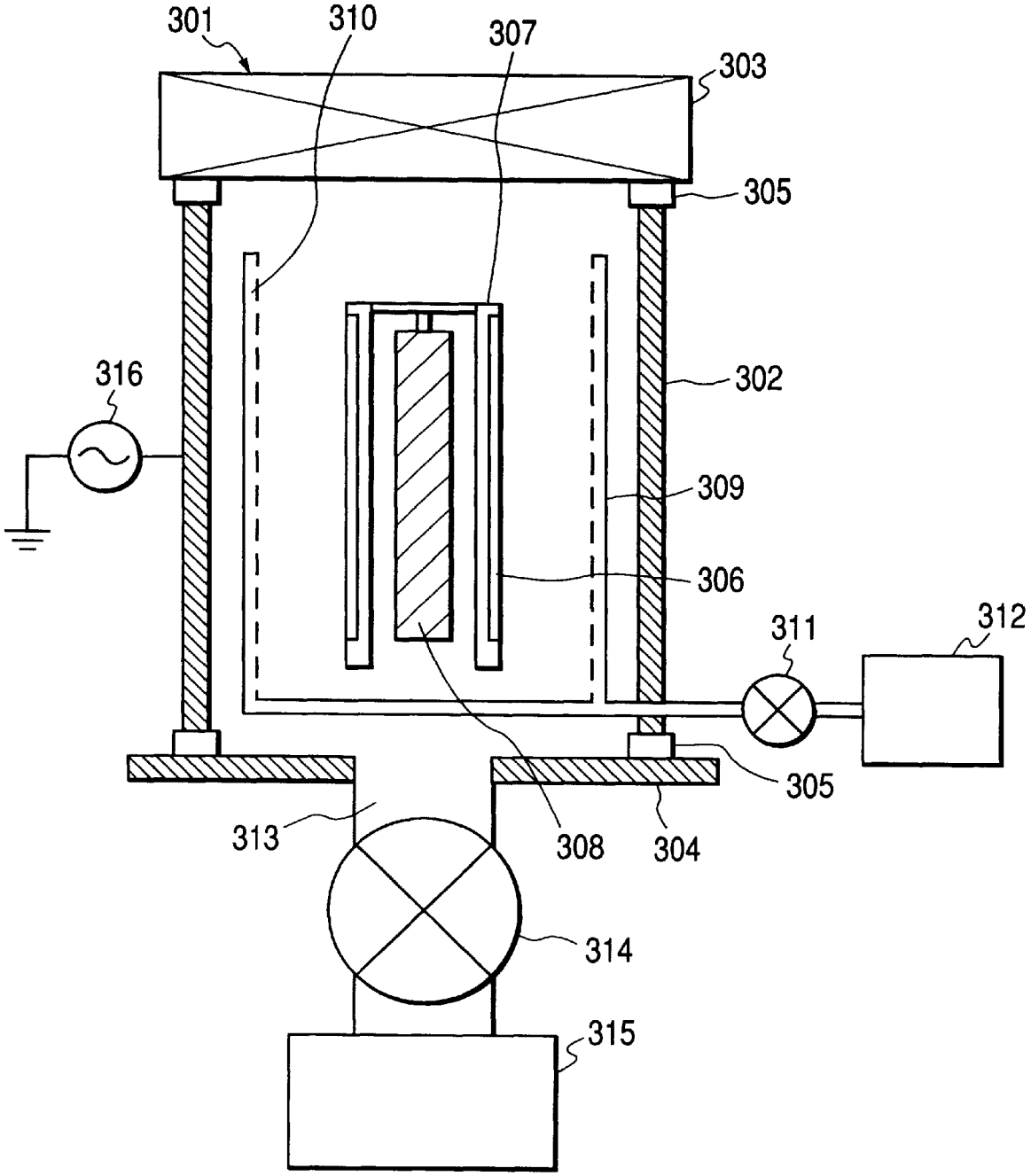
FIGS. 3, 4A, 4B and 5 are schematic sectional block diagrams, respectively, showing one example of the deposited-film forming apparatus.
Figure 6A:
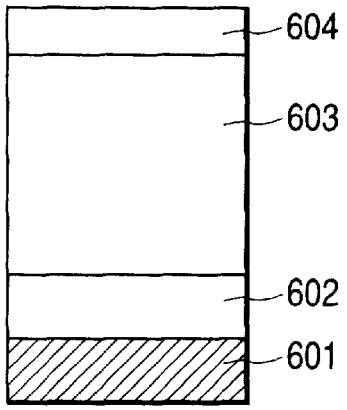
FIGS. 6A and 6B are schematically cross-sectional views, respectively, showing a layer structure of one example of the electrophotographic photosensitive member.

Then, an amorphous-silicon deposited film was formed on a substrate undergoing surface treatment in accordance with the conditions shown in Table 2 by using the deposited-film forming apparatus shown in FIG. 3 to manufacture an inhibition-type electrophotographic photosensitive member having the layer structure shown in FIG. 6A. In FIG. 6A, numeral 601 denotes an aluminum substrate, 602 denotes a charge-injection inhibiting layer, 603 denotes a photoconductive layer, and 604 denotes a surface layer.

The electrophotographic characteristic of the electrophotographic photosensitive member thus manufactured was evaluated as described below. The manufactured electrophotographic photosensitive member was set in a Canon-manufactured copying machine NP6060 which was improved so that a process speed could be optionally changed in a range of 200 to 800 mm/sec for experiments, a voltage of 6 to 7 kV was applied to a charger to perform corona charging, and a picture was formed on a transfer paper in accordance with the general copying process to perform the synthetic evaluation of black spots and image defects and environmental evaluation. Table 3 shows the evaluation results.

<Evaluation of black spot and image defect>

An image sample having most image defects was selected out of the image samples obtained when changing process speeds and putting a full-surface half-tone manuscript and a character manuscript on a manuscript table to copy them. The image sample was evaluated in accordance with the state of white points present in the same area while observing the image sample with a magnifying glass.

⊙: Good

○: There is no problem though there are some microdefects.

Δ: There is no problem on practical use though there are microdefects on the entire surface.

X: A problem may occur because there are defects on the entire surface.

<Evaluation of environmental characteristic>

○: No substance related to destruction of ozone layer is used in the pretreating step.

X: Substances related to destruction of ozone layer are used in the pretreating step.

TABLE 1

| Treating condition | Degreasing step | Cleaning (rinsing) step | Drying step |
|---|---|---|---|
| Treating agent | Nonionic surface-active agent | Pure water (10 MΩ · cm) | Pure water (10 MΩ · cm) |

TABLE 1-continued

| Treating condition | Degreasing step | Cleaning (rinsing) step | Drying step |
|---|---|---|---|
| Temperature | 40° C. | 25° C. | 40° C. |
| Treating time | 5 min | 1 min | 1 min |
| Others | Ultrasonic treatment | — | — |

TABLE 2

| | Charge-injection inhibiting layer | Photo-conductive layer | Surface layer |
|---|---|---|---|
| Type of gas and flow rate | | | |
| $SiH_4$ [sccm] | 195 | 390→430→430 | 186→169→30→25 |
| $H_2$ [sccm] | 390 | 780→2150→2150 | |
| $B_2H_6$ [ppm] (relative to $SiH_4$) | 1500 | 1.25 | |
| NO [sccm] | 6.5 | | |
| $CH_4$ [sccm] | — | — — | 751→848→1448→1527 |
| Internal pressure [mTorr] | 285 | 285→550→550 | 300→450 |
| Power [w] | 160 | 320→700→700 | 250 |
| Time [min] | 34 | Initial 10 + 350 | 31 |
| Change rate | | | |
| $SiH_4$ | | 0.4 sccm/sec | |
| $H_2$ | | 2.9 sccm/sec | |
| RF Power | | 0.9 w/sec | |
| Internal pressure | | 0.44 mTorr/sec | |

TABLE 3

| | Degreasing step | Cleaning (rinsing) step | Drying step | Synthetic evaluation results of black spot and image defect | Environmental characteristic |
|---|---|---|---|---|---|
| Potassium silicate | • | — | — | ○ | ○ |
| | — | • | — | ○ | ○ |
| | — | — | • | x | ○ |
| | • | • | — | ○ | ○ |
| | • | — | • | ○ | ○ |
| | — | • | • | ○ | ○ |
| | • | • | • | ○ | ○ |
| Comparative Experiment A1 | — | — | — | x | ○ |
| Comparative Experiment A2 | — | — | — | ○ | x |

Note: Symbol "•" denotes that an inhibitor is added, and symbol "—" denotes that no inhibitor is added.

From Table 3, preferable results were obtained by addition of an inhibitor in a surface-active agent or immediately after a surface-active agent.

<Comparative Experiment A1>

Cleaning was performed by the same method as the case of experiment A1 except for a lack of an inhibitor in the cleaning step, and thereafter an inhibiting-type electrophotographic photosensitive member was manufactured in accordance with the same method as the case of the experiment A1 and evaluated similarly to the case of the experiment A1. Table 3 shows the evaluation results of the comparative experiment A1.

<Comparative Experiment A2>

Figure 2:
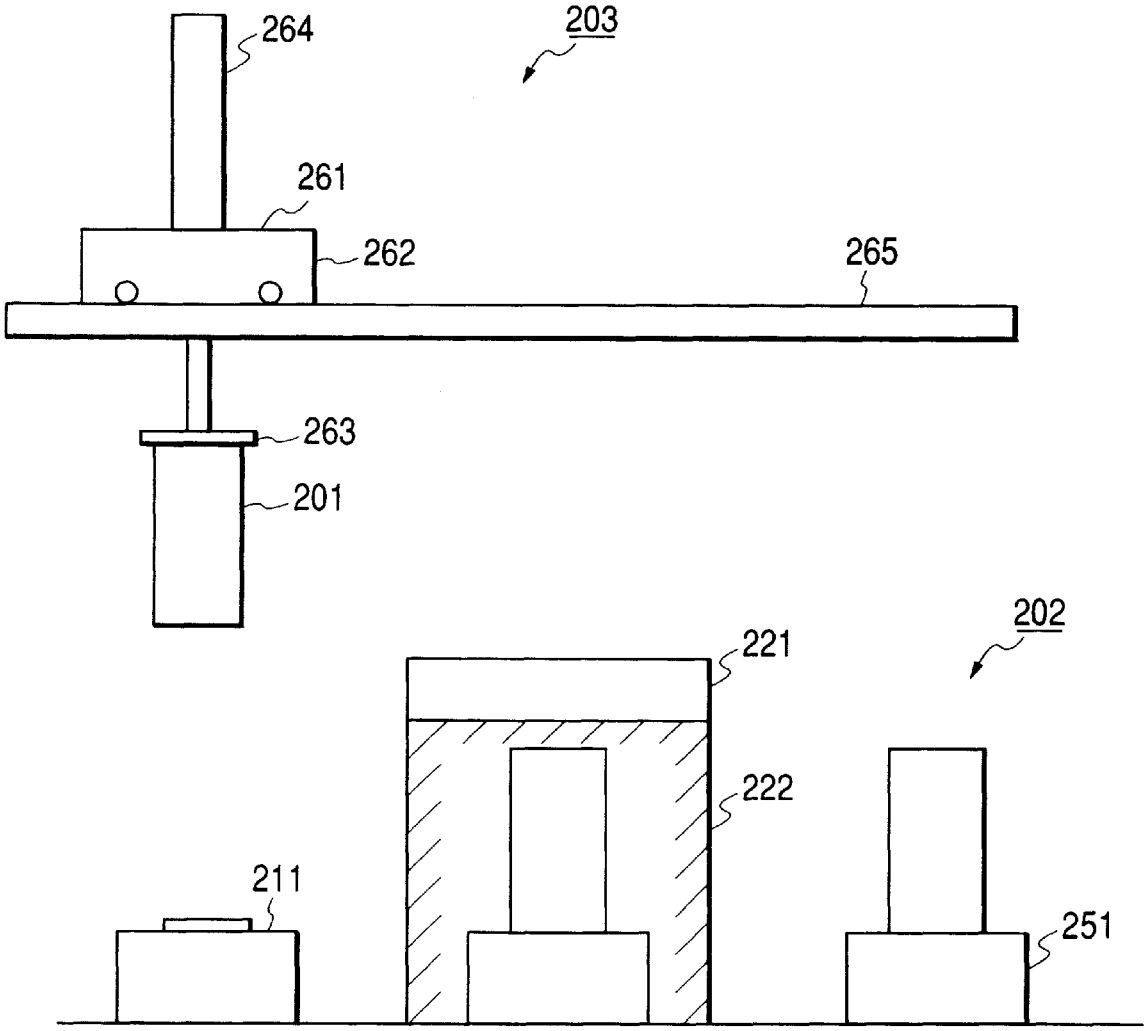

By using the same substrate as in the case of the comparative experiment A1 and a solution obtained by dissolving polybutene in 1-1-1 trichloroethane in accordance with the conditions shown in Table 4, degreasing and cleaning were performed in accordance with the conditions shown in Table 4 by the substrate-surface cleaner shown in FIG. 2.

TABLE 4

| Cleaning step | |
|---|---|
| Treating agent | 1-1-1 trichloroethane |
| Temperature | 50° C. |
| Treating time | 3 min |
| Others | Ultrasonic treatment |

The substrate cleaner shown in FIG. 2 has a treating bath 202 and a substrate-carrying mechanism 203. The treating bath 202 has a substrate mounting table 211, a substrate cleaning bath 221 and a substrate conveying-out table 251. The cleaning bath 221 is provided with a temperature regulator (not illustrated) for keeping the temperature of a solution constant. The carrying mechanism 203 has a carrying rail 265 and a carrying arm 261. The carrying arm 261 has a moving mechanism 262 moving on the rail 265, a chucking mechanism 263 for holding a substrate 201, and an air cylinder 264 for vertically moving the chucking mechanism 263.

The substrate 201 put on the mounting table 211 is carried to the cleaning bath 221 by the carrying mechanism 203 after it is cut. Cleaning to remove the cutting oil and chips from the surface of the substrate 201 is performed with the trichloroethane (trade name: ETANA VG made by ASAHI CHEMICAL INDUSTRY CO., LTD.) 222 in the cleaning bath 221.

After the substrate 201 is cleaned, it is carried to the conveying-out table 251 by the carrying mechanism 203.

Thereafter, an electrophotographic photosensitive member was manufactured in accordance with the same method as in the case of the experiment A1.

Table 3 also shows the result of evaluating the electrophotographic photosensitive member thus manufactured in the comparative experiment A2 in accordance with the same method as in the case of the experiment A1.

<Experiment A2>

An inhibiting-type electrophotographic photosensitive member was manufactured on a substrate in accordance with the same method as in the case of the experiment A1, except for use of the water shown in Table 5 in the rinsing and drying steps shown in Table 1 of the experiment A1 and thereafter, the electrophotographic photosensitive member was evaluated in accordance with the same method as in the case of the experiment A1. Table 6 shows the evaluation results of the experiment A2.

TABLE 5

| | | Cleaning (rinsing) step | Drying step |
|---|---|---|---|
| Experiment A2 | (1) | Pure water (10 MΩ · cm) | Carbon-dioxide aqueous soiution (18 μS/cm) |
| | (2) | Carbon-dioxide aqueous solution (18 μS/cm) | Pure water (10 MΩ · cm) |
| | (3) | Carbon-dioxide aqueous solution (18 μS/cm) | Carbon-dioxide aqueous solution (18 μS/cm) |

TABLE 6

| | Degreasing step | | Cleaning (rinsing) step | Drying step | Synthetic evaluation results of black spot and image defect | Environmental characteristic |
|---|---|---|---|---|---|---|
| Potassium silicate | • | (1) | — | — | ○ | ○ |
| | | (2) | — | — | ○ | ○ |
| | | (3) | — | — | ○ | ○ |
| | — | (1) | • | — | ○ | ○ |
| | | (2) | • | — | ○ | ○ |
| | | (3) | • | — | ○ | ○ |
| | — | (1) | — | • | x | ○ |
| | | (2) | — | • | Δ | ○ |
| | | (3) | — | • | Δ | ○ |
| | • | (1) | • | — | ○ | ○ |
| | | (2) | • | — | ○ | ○ |
| | | (3) | • | — | ○ | ○ |
| | • | (1) | — | • | ○ | ○ |
| | | (2) | — | • | ○ | ○ |
| | | (3) | — | • | ○ | ○ |
| | — | (1) | • | • | ○ | ○ |
| | | (2) | • | • | ○ | ○ |
| | | (3) | • | • | ○ | ○ |
| | • | (1) | • | • | ○ | ○ |
| | | (2) | • | • | ○ | ○ |
| | | (3) | • | • | ○ | ○ |

Note: Symbol "•" denotes that an inhibitor is added, and symbol "—" denotes that no inhibitor is added.

As shown in Table 6, preferable results were obtained by using a mixture of a carbon-dioxide aqueous solution with pure water in the cleaning (rinsing) step and the drying step and by adding an inhibitor to a surface-active agent or immediately after the surface-active agent.

<Experiment A3>

The same substrate as in the case of the experiment A1 was used, types of the silicate were changed as shown in Table 8, and cleaning of the substrate was conducted in accordance with the method shown in Table 7. Thereafter, an inhibiting-type electrophotographic photosensitive member was formed on the substrate in accordance with the same method as in the case of the experiment A1 and measured in accordance with the same method. Table 8 shows the results.

TABLE 7

| Treating condition | Degreasing step | Cleaning (rinsing) step | Drying step |
|---|---|---|---|
| Treating agent | Nonionic surface-active agent | Pure water (10 MΩ · cm) | Pure water (10 MΩ · cm) |
| Temperature | 40° C. | 25° C. | 40° C. |

TABLE 7-continued

| Treating condition | Degreasing step | Cleaning (rinsing) step | Drying step |
|---|---|---|---|
| Treating time | 5 min | 1 min | 1 min |
| Others | Ultrasonic treatment | — | — |
| Inhibitor | • | — | — |

TABLE 8

| | | Synthetic evaluation results of black spot and image defect |
|---|---|---|
| Inhibitor | Potassium silicate | ◎ |
| | Sodium silicate | ○ |
| | Magnesium silicate | ○ |

As clearly shown in Table 8, though preferable results were obtained from any type of silicates, the most preferable result was obtained by potassium silicate.

<Experiment A4>

By using the same substrate as in the case of the experiment A1, cleaning was performed in accordance with the same conditions shown in Table 7 as in the case of the experiment A3. By changing concentrations of the potassium silicate introduced when cleaning was performed as shown in Table 9, the stain state on the substrate surface after cleaned was observed by the naked eye. Thereafter, an inhibiting-type electrophotographic photosensitive member was manufactured in accordance with the same method as the case of the experiment A1 and evaluated in accordance with the same method as the case of the experiment A1. Table 9 shows the results.

<Appearance (Stain)>

By reflecting strong exposure light on the substrate surface after cleaned, a stain on the substrate was confirmed by the naked eye.

○: Good because no stain is found.

Δ: There is no problem because a stain is very thin.

X: A stain is clearly recognized.

TABLE 9

| | | Potassium silicate concentration (%) | Appearance (Stain) | Synthetic evaluation results of black spot and image defect |
|---|---|---|---|---|
| Experiment A4 | 1) | 0.03 | Δ | Δ |
| | 2) | 0.05 | ○ | ○ |
| | 3) | 0.10 | ○ | ○ |
| | 4) | 0.30 | ◎ | ◎ |
| | 5) | 0.50 | ◎ | ◎ |
| | 6) | 0.80 | ◎ | ◎ |
| | 7) | 1.20 | ◎ | ◎ |
| | 8) | 1.50 | ◎ | ◎ |
| | 9) | 2.00 | ○ | ○ |
| | 10) | 2.20 | Δ | Δ |

From the results in Table 9, preferable results were obtained in a potassium silicate concentration of 0.05 to 2.00% both inclusive.

<Experiment A5>

By using aluminum having Si, Fe and Cu contents changed as shown in Table 10, degreasing and cleaning were performed in accordance with the same method as the case of the experiment A3. Thereafter, an inhibiting-type electrophotographic photosensitive member was manufactured in accordance with the same method as the case of the experiment A1 and evaluated in accordance with the same method as the case of the experiment A1. Table 10 shows the results.

TABLE 10

| | | Si, Fe and Cu contents (wt. %) | | | Synthetic evaluation results of black spot and image defect |
|---|---|---|---|---|---|
| | | Si | Fe | Cu | |
| Experiment A5 | (1) | 0.004 | 0.002 | 0.004 | Δ |
| | (2) | 0.005 | 0.004 | 0.002 | ◎ |
| | (3) | 0.003 | 0.02 | 0.01 | ◎ |
| | (4) | 0.01 | 0.02 | 0.005 | ◎ |
| | (5) | 0.02 | 0.003 | 0.05 | ◎ |
| | (6) | 0.1 | 0.04 | 0.06 | ◎ |
| | (7) | 0.3 | 0.05 | 0.20 | ◎ |
| | (8) | 0.5 | 0.4 | 0.1 | ○ |

As clearly shown in Table 10, the present invention is effective even when the contents of Si, Fe and Cu are changed in a range of 0.01 wt. %<Si+Fe+Cu≦1 wt. %.

<Experiment A6>

An inhibiting-type electrophotographic photosensitive member was manufactured in accordance with the same method as the case of the experiment A4 except for fixing the content of Fe to 0.003 wt. % and the content of Cu to 0.006 wt. %, and changing the content of Si as shown in Table 11 and evaluated similarly to the case of the experiment A4. Table 11 shows the evaluation results.

TABLE 11

| | | Si content (wt. %) | Synthetic evaluation results of black spot and image defect |
|---|---|---|---|
| Experiment A6 | (1) | 0.001 | ○ |
| | (2) | 0.002 | ◎ |
| | (3) | 0.03 | ◎ |
| | (4) | 0.07 | ◎ |
| | (5) | 0.42 | ◎ |
| | (6) | 0.63 | ◎ |
| | (7) | 0.98 | ◎ |
| | (8) | 1.0 | ○ |
| | (9) | 1.15 | Δ |

As clearly shown in Table 11, preferable results were obtained in a range of 0.001 wt. %≦Si≦1.0 wt. %.

<Experiment A7>

An inhibiting-type electrophotographic photosensitive member was manufactured in accordance with the same method as the case of the experiment A5 except for fixing the content of Si to 0.005 wt. % and the content of Cu to 0.004 wt %, and changing the content of Fe as shown in Table 12 and evaluated similarly to the case of the experiment A5. Table 12 shows the evaluation results.

TABLE 12

| | | Fe content (wt. %) | Synthetic evaluation results of interference fringe, black spot, and image defect |
|---|---|---|---|
| Experiment A7 | 1) | 0.001 | ○ |
| | 2) | 0.002 | ◎ |
| | 3) | 0.03 | ◎ |

TABLE 12-continued

| | | Fe content (wt. %) | Synthetic evaluation results of interference fringe, black spot, and image defect |
|---|---|---|---|
| | 4) | 0.07 | ◎ |
| | 5) | 0.42 | ◎ |
| | 6) | 0.63 | ◎ |
| | 7) | 0.92 | ◎ |
| | 8) | 1.0 | ○ |
| | 9) | 1.15 | Δ |

As clearly shown in Table 12, preferable results were obtained in a range of 0.001 wt. %≦Fe≦1.0 wt. %.

<Experiment A8>

An inhibiting-type electrophotographic photosensitive member was manufactured in accordance with the same method as the case of the experiment A4 except for fixing the content of Si to 0.006 wt. % and the content of Fe to 0.003 wt. %, and changing the contents of Cu as shown in Table 13 and evaluated similarly to the case of the experiment A4. Table 13 shows the evaluation results.

TABLE 13

| | | Cu content (wt. %) | Synthetic evaluation results of interference fringe, black spot, and image defect |
|---|---|---|---|
| Experiment A8 | 1) | 0.001 | ○ |
| | 2) | 0.002 | ◎ |
| | 3) | 0.03 | ◎ |
| | 4) | 0.07 | ◎ |
| | 5) | 0.42 | ◎ |
| | 6) | 0.63 | ◎ |
| | 7) | 0.92 | ◎ |
| | 8) | 1.0 | ○ |
| | 9) | 1.15 | Δ |

As clearly shown in Table 13, preferable results were obtained in a range of 0.001 wt. %≦Cu≦1.0 wt. %.

<Experiment A9>

Figure 7:
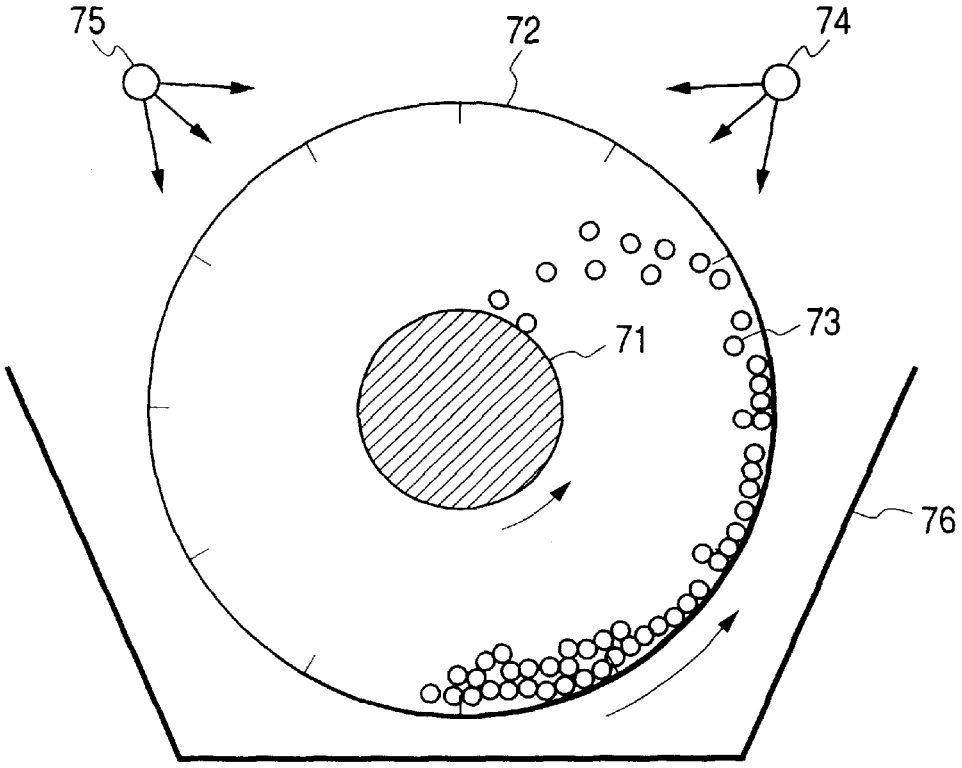
FIGS. 7 and 8 are schematically cross-sectional block diagrams showing an apparatus for forming a spherical trace dent.
Figure 8:
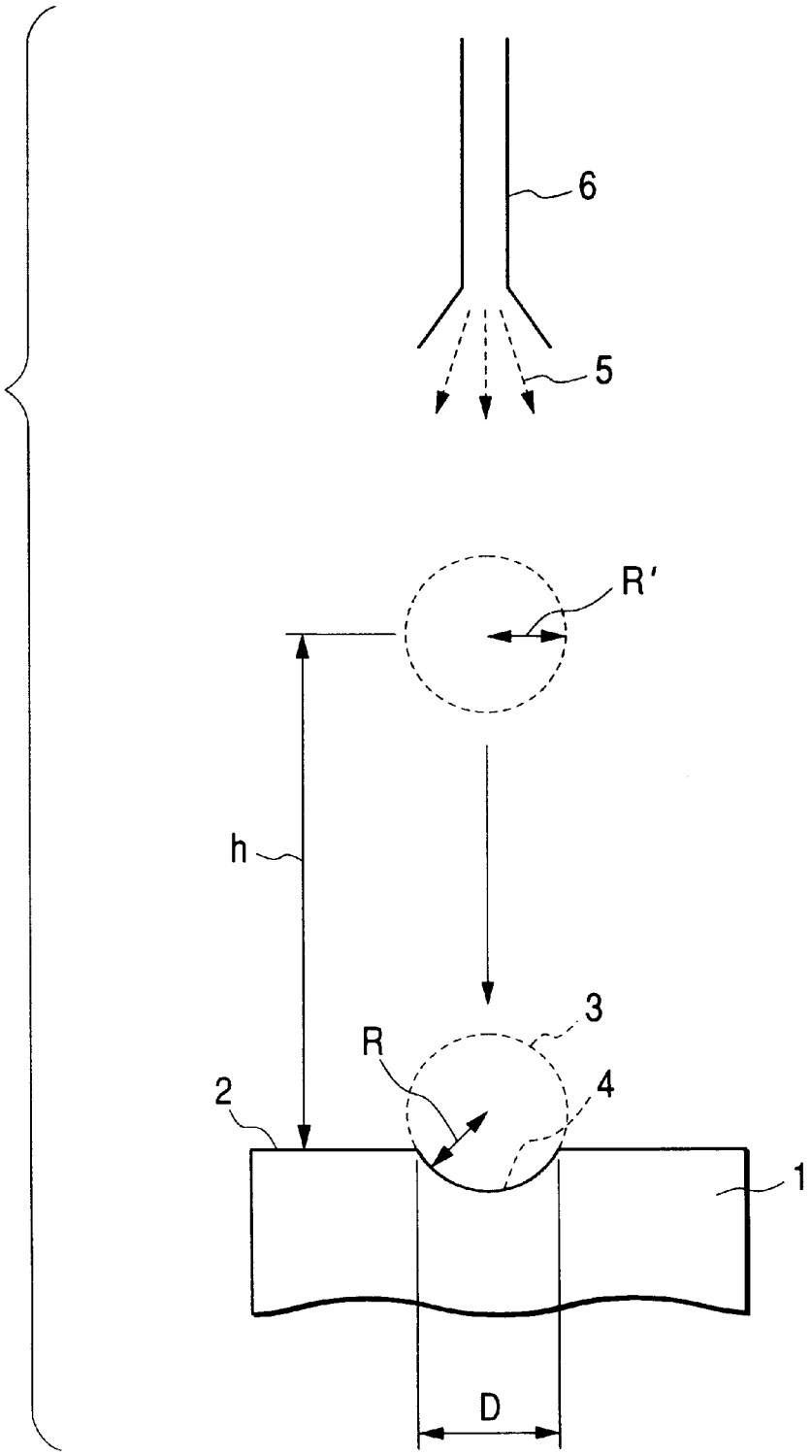

The surface of an aluminum substrate (diameter of 108 mm and length of 358 mm) was treated to form a surface irregularity by using an SUS stainless-steel rigid complete sphere having a diameter of 2 mm and the apparatus of the present invention shown in FIG. 7.

As the result of examining the relationship between complete-sphere diameter R', dropping height h, trace dent curvature R, and width D, it was confirmed that the trace dent curvature R and width D were determined in accordance with the complete-sphere diameter R' and dropping height h. Moreover, it was confirmed that the trace dent pitch (trace dent density or irregularity pitch) could be adjusted to a desired value by controlling the rotational speed or number of a cylinder, or the dropping number of a rigid complete spheres.

<Experiment A10>

The surface of a cylindrical substrate made of aluminum containing 0.05 wt. % of Si, 0.03 wt. % of Fe, and 0.01 wt. % of Cu and having a diameter of 108 mm, a length of 358 mm, and a thickness of 5 mm was cut in accordance with the same procedure as the case of the above-mentioned method of the present invention for manufacturing an electrophotographic photosensitive member.

Degreasing was performed with a detergent (nonionic surface-active agent) containing an inhibitor in accordance with the conditions shown in Table 14 by the surface treating apparatus of the present invention shown in FIG. 7 when 15 min passes after the cutting step is completed, and simultaneously irregularity was formed by changing D/R. Thereafter, cleaning was performed by a water system. Every D of a support of a light-receiving member was set to 500 μm, and the inhibitor used for degreasing and roughening was added to the aqueous solution of a surface-active agent in an amount of 3 g/l to set to pH 11.0.

In the above case, surface defects (stripe defects) formed on the treated surface of each substrate were inspected by the naked eye and a metallurgical microscope. Table 16 shows the observation results.

Then, an amorphous-silicon deposited film was formed on these surface-treated substrates under the conditions in Table 15 by using the deposited-film forming apparatus shown in FIG. 3 to manufacture an inhibiting-type electrophotographic photosensitive member having the layer structure shown in FIG. 6A. In FIG. 6A, numeral 601 denotes an aluminum substrate, 602 denotes a charge-injection inhibiting layer, 603 denotes a photoconductive layer, and 604 denotes a surface layer.

The electrophotographic characteristic of the electrophotographic photosensitive member thus obtained was evaluated as shown below.

The electrophotographic photosensitive member was set in the copying machine NP6650 made by CANON INC. modified so as to be able to optionally change the process speed of the obtained electrophotographic photosensitive member in a range of 200 to 800 mm/sec for experiment, perform corona charging by applying a voltage of 6 to 7 kV to a charger, form a latent image on the surface of the obtained electrophotographic photosensitive member by 788-nm laser image exposure, and then form an image on a transfer paper by the normal copying process. The interference fringes, black spots, image defects and environmental characteristics were synthetically evaluated.

<Evaluation of interference fringe, black spot and image defect>

An image sample on which most image defects appeared was selected out of the image samples obtained by changing the process speed, putting an entire-surface half-tone manuscript and a character manuscript on a manuscript table, and copying them to evaluate the image sample. The image sample was evaluated in accordance with the state of white points present in the same area while observing the image sample with a magnifying glass.

◎: Good

●: There is no problem though there are some microdefects.

Δ: There is no problem in practical use though there are microdefects on the entire surface.

X: A problem may occur because there are defects on the entire surface.

<Evaluation of environmental characteristic>

○: No substance related to destruction of ozone layer is used in the pretreating step.

X: Substances related to destruction of ozone layer are used in the pretreating step.

TABLE 14

| | Roughening step (irregularity forming step) | |
|---|---|---|
| Treating condition Treating agent | Detergent aqueous solution (Nonionic surface-active agent) | Carbon-dioxide aqueous solution (20 μS/cm) |
| Temperature | 40° C. | 25° C. |
| Treating time | 5 min | 3 min |
| Inhibitor | Potassium silicate | — |

TABLE 15

| | Charge-injection inhibiting layer | Photo-conductive layer | Surface layer |
|---|---|---|---|
| Type of gas and flow rate | | | |
| $SiH_4$ [sccm] | 195 | 390→430→430 | 186→169→30→25 |
| $H_2$ [sccm] | 390 | 780→2150→2150 | |
| $B_2H_6$ [ppm] (relative to $SiH_4$) | 1500 | 1.25 | |
| NO [sccm] | 6.5 | — | |
| $CH_4$ [sccm] | — | — | 751→848→1448→1527 |
| Internal pressure [mTorr] | 285 | 285→550→550 | 300→450 |
| Power [w] | | | |
| Time [min] | 160 | 320→700→700 | 250 |
| | 34 | Initial 10 + 350 | 31 |
| Change rate | | | |
| $SiH_4$ | | 0.4 sccm/sec | |
| $H_2$ | | 2.9 sccm/sec | |
| RF Power | | 0.9 w/sec | |
| Internal pressure | | 0.44 mTorr/sec | |

TABLE 16

| | | Synthetic evaluation results of interference fringe, black spot, and image defect | | Environmental characteristic | |
|---|---|---|---|---|---|
| | | Experiment A10 | Comparative Experiment A3 | Experiment A10 | Comparative Experiment A3 |
| D/R | 0.02 | x | x | ○ | x |
| | 0.03 | Δ | Δ | ○ | x |
| | 0.036 | ○ | ○ | ○ | x |
| | 0.05 | ◎ | ◎ | ○ | x |
| | 0.08 | ◎ | ◎ | ○ | x |
| | 0.10 | ◎ | ◎ | ○ | x |
| | 0.24 | ◎ | ◎ | ○ | x |
| | 0.38 | ◎ | ◎ | ○ | x |
| | 0.50 | ◎ | ◎ | ○ | x |
| | 0.53 | Δ | ◎ | ○ | x |

Preferable results were obtained in a range of $0.035 \leqq D/R \leqq 0.5$.

<Comparative Experiment A3>

In the roughing step, irregularity was formed under the same D/R conditions as in the case of the experiment A10 by using a solution obtained by dissolving polybutene in 1-1-1 trichloroethane in accordance with the conditions shown in Table 17. Thereafter, a substrate was degreased and cleaned in accordance with the conditions shown in Table 17 by the substrate-surface cleaner shown in FIG. 2.

The substrate 201 put on the mounting table 211 after cutting is carried to the cleaning bath 221 by the carrying mechanism 203. In the case of this experiment, the substrate was cleaned with trichloroethane (trade name: ETANA VG made by ASAHI CHEMICAL INDUSTRY CO., LTD.) 222 in the cleaning bath 221 in order to remove the cutting oil and chips from the surface of the substrate.

After cleaning, the substrate 201 was carried to the conveying-out table 251 by the carrying mechanism 203.

Thereafter, an electrophotographic photosensitive member was manufactured in accordance with the same method as in the case of the experiment A10.

Table 16 also shows the result of evaluating the electrophotographic photosensitive member thus obtained in the comparative experiment A3 in accordance with the same method as in the case of the experiment A10.

TABLE 17

| | Roughening step | Cleaning step |
|---|---|---|
| Treating agent | *1-1-1 trichloroethane + polybutene | 1-1-1 trichloroethane |
| Temperature | Room temperature | 50° C. |
| Treating time | 5 min | 3 min |
| Others | — | Ultrasonic treatment |

*A treating solution in which 5% of polybutene was dissolved was used.

<Experiment A11>

The width D of a spherical trace dent was changed as shown in Table 18 by using the same substrate as that used in the experiment A10 and using a rigid complete sphere having a radius of 1 mm for roughening. Thereafter, an inhibiting-type electrophotographic photosensitive member was formed on the substrate in accordance with the same method as in the case of the experiment A10 to evaluate the photosensitive member in accordance with the same method as in the case of the experiment A10. Table 18 shows the evaluation results.

TABLE 18

| | | Synthetic evaluation results of interference fringe, black spot, and image defect | Environmental characteristic |
|---|---|---|---|
| D | 2 | Δ | ○ |
| μm | 4 | ○ | ○ |
| | 10 | ◎ | ○ |
| | 50 | ◎ | ○ |
| | 200 | ◎ | ○ |
| | 350 | ◎ | ○ |
| | 500 | ◎ | ○ |
| | 550 | Δ | ○ |

As clearly shown in Table 18, preferable results were obtained in a range of $4\ \mu m \leqq D \leqq 500\ \mu m$.

<Experiment A12>

The inhibitor was changed which was used when setting D/R to 0.056 in the same degreasing and roughing step as in the case of the experiment A10 by using the same substrate as that used in the experiment A10. Thereafter, the same inhibiting-type electrophotographic photosensitive member as in the case of the experiment A10 was manufactured and evaluated similarly to the case of the experiment A10. Table 19 shows the evaluation results. Each inhibitor of 3 g/l was added to each surface-active aqueous solution and the pH of each solution was set to 10.5.

TABLE 19

| | | Synthetic evaluation results of interference fringe, black spot, and image defect |
|---|---|---|
| Inhibitor | Potassium silicate | ◎ |
| | Sodium silicate | ○ |
| | Magnesium silicate | ○ |

As shown in Table 19, preferable results were obtained by using any silicate. Particularly, however, the most preferable result was obtained by using potassium silicate.

<Experiment A13>

Regions containing potassium silicate were changed in the step of performing cleaning (rinsing) together with degreasing and roughing in the same apparatus by using the same substrate as in the case of the experiment A10, as shown in Table 20.

Thereafter, water-based cleaning was performed to form the same inhibiting-type electrophotographic photosensitive member as in the case of the experiment A10 and evaluate the electrophotographic photosensitive member similarly to the case of the experiment A10. Table 20 shows the evaluation results. In this case, the surface-active agent shown in Table 20 was a nonionic surface-active agent, and 3 g/l of potassium silicate as an inhibitor was introduced into a treating solution to set the pH of the solution to 10.8. D/R was set to 0.056.

TABLE 20

| | Roughening step | | Synthetic evaluation result of interference |
|---|---|---|---|
| | Degreasing and roughening step | Cleaning (rinsing) step | fringe, black spot, and image defect |
| (1) | SA + PS | PW | ○ |
| (2) | SA + PS | CD | ○ |
| (3) | SA | PW + PS | ○ |
| (4) | SA | CD + PS | ○ |
| (5) | SA + PS | PW + PS | ○ |
| (6) | SA + PS | CD + PS | ○ |
| Comparative experiment 4 | SA | CD | x |
| Comparative experiment 5 | SA | PW | x |

Note: SA: Surface-active agent
PS: Potassium silicate
PW: Pure water (10 MΩ · cm)
CD: Carbon-dioxide aqueous solution (10 μS/cm)

<Comparative experiment 4>

An inhibiting-type electrophotographic photosensitive member was formed on the same substrate in as the case of the experiment A13 in accordance with the same method as in the case of the experiment A13 except for using a detergent (surface-active agent) not containing potassium silicate in the degreasing and roughening step and thereafter using a carbon-dioxide aqueous solution of 10 μS/cm in the cleaning (rinsing) step in the same apparatus, and evaluated similarly to the case of the experiment A13. Table 20 shows the evaluation results of the comparative experiment 4.

<Comparative experiment 5>

An inhibiting-type electrophotographic photosensitive member was formed on the same substrate as in the case of the experiment A13 in accordance with the same method as in the case of the experiment A13 except for using a detergent (surface-active agent) not containing potassium silicate in the degreasing and roughing step and thereafter using pure water of 10 MΩ·cm in the cleaning (rinsing) step in the same apparatus, and evaluated similarly to the case of the experiment A13. Table 20 also shows the evaluation results of the comparative experiment 5.

Thus, it is found that the present invention is effective even by using potassium silicate in any one of the degreasing and roughening step or the cleaning (rinsing) step in the same apparatus for roughening.

<Experiment A14>

Degreasing, roughening, and cleaning (rinsing) were performed in accordance with the conditions shown in Table 21 by using the same substrate as in the case of the experiment A10. Thereafter, an inhibiting-type electrophotographic photosensitive member was formed in accordance with the same method as in the case of the experiment A10 by using the cleaner shown in FIG. 1 and performing cleaning (rinsing and drying) in accordance with the conditions shown in Table 22, and evaluated similarly to the case of the experiment A10. Table 22 shows the evaluation results. In this case, D/R was set to 0.053, 3 g/l of the inhibitor in Table 22 was added to a treating solution, and the pH of the solution was set to 11.

TABLE 21

| | Roughing step | |
|---|---|---|
| Treating condition Treating agent | Detergent aqueous solution (Nonionic surface-active agent) | Pure water (10 MΩ · cm) |
| Temperature | 40° C. | 25° C. |
| Treating time | 5 min | 3 min |
| Inhibitor | Potassium silicate (3 g/l) | — |

TABLE 22

| | Cleaning (rinsing and drying) step | | Synthetic evaluation results of interference fringe, black spot, and |
|---|---|---|---|
| | Cleaning step | Drying step | image defect |
| Treating agent | Pure water (10 MΩ · cm) | Pure water (10 MΩ · cm) | ○ |
| | Pure water (10 MΩ · cm) | Carbon-dioxide aqueous solution (20 μS/cm) | ○ |
| | Carbon-dioxide aqueous solution (20 μS/cm) | Pure water (10 MΩ · cm) | ○ |
| | Carbon-dioxide aqueous solution (20 μS/cm) | Carbon-dioxide aqueous solution (20 μS/cm) | ○ |

TABLE 22-continued

| Cleaning (rinsing and drying) step | | Synthetic evaluation results of interference fringe, black spot, and |
|---|---|---|
| Cleaning step | Drying step | image defect |
| Pure water (10 MΩ · cm) + Potassium silicate | Pure water (10 MΩ · cm) | ○ |
| Pure water (10 MΩ · cm) + Potassium silicate | Carbon-dioxide aqueous solution (20 μS/cm) | ○ |
| Carbon-dioxide aqueous solution (20 uS/cm) + Potassium silicate | Pure water (10 MΩ · cm) | ○ |
| Carbon-dioxide aqueous solution (20 μS/cm) + Potassium silicate | Carbon-dioxide aqueous solution (20 μS/cm) | ○ |
| Pure water (10 MΩ · cm) | Pure water (10 MΩ · cm) + Potassium silicate | ○ |
| Pure water (10 MΩ · cm) | Carbon-dioxide aqueous solution (20 μS/cm) + Potassium silicate | ○ |
| Carbon-dioxide aqueous solution (20 μS/cm) | Pure water (10 MΩ · cm) + Potassium silicate | ○ |
| Carbon-dioxide aqueous solution (20 μS/cm) | Carbon-dioxide aqueous solution (20 μS/cm) + Potassium silicate | ○ |
| Pure water (10 MΩ · cm) + Potassium silicate | Pure water (10 MΩ · cm) + Potassium silicate | ○ |
| Pure water (10 MΩ · cm) + Potassium silicate | Carbon-dioxide aqueous solution (20 μS/cm) + Potassium silicate | ○ |
| Carbon-dioxide aqueous solution (20 μS/cm) + Potassium silicate | Pure water (10 MΩ · cm) + Potassium silicate | ○ |
| Carbon-dioxide aqueous solution (20 μS/cm) + Potassium silicate | Carbon-dioxide aqueous solution (20 μS/cm) | ○ |

As clearly shown in Table 22, by using potassium silicate in the degreasing and roughing step, the present invention is effective even under any condition in the subsequent cleaning (rinsing and drying) step.

<Experiment A15>

Degreasing and roughening were performed in accordance with the same method as in the case of the experiment A14. Thereafter, cleaning was performed by using the step of performing ultrasonic treatment with a surface-active agent before the step of performing cleaning (rinsing and drying) in accordance with the conditions shown in Table 22 of the experiment A14. As a result, the same effect as in the case of the experiment A14 was obtained under any condition.

<Experiment A16>

Degreasing, roughening and cleaning (rinsing) were performed in accordance with the conditions shown in Table 23 by using aluminum obtained by changing the content of Si, Fe and Cu as shown in Table 25, and then cleaning was performed in accordance with the conditions shown in Table 24. Thereafter, the same inhibiting-type electrophotographic photosensitive member as in the case of the experiment A10 was manufactured, and evaluated similarly to the case of the experiment A10. In this case, the pH of the treating solution introducing an inhibitor was set to 11. Table 25 shows the evaluation results.

TABLE 23

| | Roughening step | |
|---|---|---|
| Treating condition Treating agent | Detergent aqueous solution (Nonionic surface-active agent) | Carbon-dioxide aq. solution (10 μS/cm) |
| Temperature | 40° C. | 25° C. |
| Treating time | 5 min | 3 min |
| Inhibitor | Potassium silicate (3 g/l) | — |

TABLE 24

| Treating condition | Cleaning step 1 | Cleaning step 2 | Drying step |
|---|---|---|---|
| Treating agent | Nonionic surface-active agent | Carbon-dioxide aqueous solution (10 μS/cm) | Pure water (10 MΩ · cm) |
| Temperature | 40° C. | 25° C. | 40° C. |
| Treating time | 5 min | 1 min | 1 min |
| Others | Ultrasonic treatment | — | — |

TABLE 25

| | | Content of Si, Fe and Cu (wt. %) | | | Synthetic evaluation results of interference fringe, black spot, and image defect |
|---|---|---|---|---|---|
| | | Si | Fe | Cu | |
| Experiment A16 | (1) | 0.005 | 0.002 | 0.003 | Δ |
| | (2) | 0.004 | 0.003 | 0.004 | ◎ |
| | (3) | 0.005 | 0.01 | 0.01 | ◎ |
| | (4) | 0.01 | 0.003 | 0.02 | ◎ |
| | (5) | 0.02 | 0.001 | 0.05 | ◎ |
| | (6) | 0.1 | 0.01 | 0.05 | ◎ |
| | (7) | 0.2 | 0.3 | 0.01 | ◎ |
| | (8) | 0.3 | 0.4 | 0.3 | ○ |

As clearly shown in Table 25, the present invention is effective even when the content of Si, Fe and Cu are changed in a range of 0.01 wt. %<Si+Fe+Cu≦1 wt. %.

<Experiment A17>

An inhibiting-type electrophotographic photosensitive member was manufactured in accordance with the same method as in the case of the experiment A16 except for fixing the content of Fe to 0.005 wt. % and the content of Cu to 0.004 wt. % and changing the contents of Si as shown in Table 26, and evaluated similarly to the case of the experiment A16. Table 26 shows the evaluation results.

TABLE 26

| | | Si content (wt. %) | Synthetic evaluation results of interference fringe, black spot, and image defect |
|---|---|---|---|
| Experiment A17 | (1) | 0.001 | ○ |
| | (2) | 0.002 | ◎ |
| | (3) | 0.01 | ◎ |
| | (4) | 0.05 | ◎ |
| | (5) | 0.35 | ◎ |
| | (6) | 0.73 | ◎ |
| | (7) | 0.90 | ◎ |
| | (8) | 1.0 | ○ |
| | (9) | 1.1 | Δ |

As clearly shown in Table 26, preferable results were obtained in a range of 0.001 wt. %≦Si≦1.0 wt. %.

<Experiment A18>

An inhibiting-type electrophotographic photosensitive member was manufactured in accordance with the same method as in the case of the experiment A16 except for fixing the content of Si to 0.004 wt. % and the content of Cu to 0.005 wt. % and changing the content of Fe as shown in Table 27, and evaluated similarly to the case of the experiment A16. Table 27 shows the evaluation results.

TABLE 27

| | | Fe content (wt. %) | Synthetic evaluation results of interference fringe, black spot, and image defect |
|---|---|---|---|
| Experiment A18 | (1) | 0.001 | ○ |
| | (2) | 0.002 | ◎ |
| | (3) | 0.01 | ◎ |
| | (4) | 0.05 | ◎ |
| | (5) | 0.35 | ◎ |
| | (6) | 0.73 | ◎ |
| | (7) | 0.90 | ◎ |
| | (8) | 1.0 | ○ |
| | (9) | 1.1 | Δ |

As clearly shown in Table 27, preferable results were obtained in a range of 0.001 wt. %≦Fe≦1.0 wt. %.

<Experiment A19>

An inhibiting-type electrophotographic photosensitive member was manufactured in accordance with the same method as in the case of the experiment A16 except for fixing the content of Si to 0.004 wt. % and the content of Fe to 0.005 wt. % and changing the content of Cu as shown in Table 28, and evaluated similarly to the case of the experiment A16. Table 28 shows the evaluation results.

TABLE 28

| | | Cu content (wt. %) | Synthetic evaluation results of interference fringe, black spot, and image defect |
|---|---|---|---|
| Experiment A19 | (1) | 0.001 | ○ |
| | (2) | 0.002 | ◎ |
| | (3) | 0.01 | ◎ |
| | (4) | 0.05 | ◎ |
| | (5) | 0.35 | ◎ |
| | (6) | 0.73 | ◎ |
| | (7) | 0.99 | ◎ |
| | (8) | 1.0 | ○ |
| | (9) | 1.1 | Δ |

As clearly shown in Table 28, preferable results were obtained in a range of 0.001 wt. %≦Cu≦1.0 wt. %.

<Experiment B1>

The surface of a cylindrical substrate made of aluminum containing 0.05 wt. % of Si, 0.03 wt. % of Fe, and 0.01 wt. % of Cu and having a diameter of 108 mm, a length of 358 mm, and a thickness of 5 mm was cut in accordance with the procedure for the above-mentioned method of the present invention for manufacturing an electrophotographic photosensitive member. The ratio of all atoms present on a substrate used in the present invention was measured in accordance with the X-ray photoelectron spectrometry by using Mg for an X-ray anode under conditions of 15 kV and 400 W, an energy resolution of 0.98 eV (Ag3d5/2), and a vacuum degree of $1\times10^{-9}$ Torr or less.

When 15 min passed after cutting was completed, degreasing, rinsing and drying were performed with a detergent (nonionic surface-active agent) by the surface treating apparatus of the present invention shown in FIG. 1 in accordance with the conditions shown in Table 29. In this case, baths for storing an inhibitor were changed as shown in Table 31. (The inhibitor used A-POTASSIUM SILICATE (trade name) made by Nippon Chemical Industrial Co., Ltd. A-POTASSIUM SILICATE is a solution made by dissolving 400 g of potassium silicate ($K_2O\cdot3SiO_2$) in 1 kg of A-POTASSIUM SILICATE.) Moreover, the pH of the water in which potassium silicate was dissolved was 11.0. Then, surface defects (stripe defects and the like) generated when the surface of the substrate was treated were inspected by the naked eye and a metallurgical microscope. Table 31 shows the inspection results.

Then, an amorphous-silicon deposited film was formed on these surface-treated substrates by the deposited-film forming apparatus shown in FIG. 3 in accordance with the conditions in Table 30 to manufacture an inhibiting-type electrophotographic photosensitive member having the layer structure shown in FIG. 6A. In FIG. 6A, numeral 601 denotes an aluminum substrate, 602 denotes a charge-injection inhibiting layer, 603 denotes a photoconductive layer, and 604 denotes a surface layer.

The electrophotographic characteristics of the electrophotographic photosensitive member thus obtained were evaluated as shown below.

The electrophotographic photosensitive member was set in the copying machine NP6650 made by CANON INC.

modified so as to be able to optionally change the process speed in a range of 200 to 800 mm/sec for experiment, perform corona charging by applying a voltage of 6 to 7 kV to a charger, form a latent image on the surface of the obtained electrophotographic photosensitive member by 788-nm laser image exposure, and form an image on a transfer paper by the normal copying process. The black spots, and image defects, electrophotographic characteristics (photosensitivity) and environmental characteristics were synthetically evaluated. Table 31 also shows the evaluation results.

TABLE 29

| Treating condition | Degreasing step | Cleaning (rinsing) step | Drying step |
|---|---|---|---|
| Treating agent | Nonionic surface-active agent | Pure water (10 MΩ · cm) | Pure water (10 MΩ · cm) |
| Temperature | 40° C. | 25° C. | 25° C. |
| Treating time | 5 min | 1 min | 1 min |
| Others | Ultrasonic treatment | — | — |

TABLE 30

| | Charge-injection inhibiting layer | Photo-conductive layer | Surface layer |
|---|---|---|---|
| Type of gas and flow rate | | | |
| $SiH_4$ [sccm] | 200 | 400→430→430 | 186→169→30→25 |
| $H_2$ [sccm] | 400 | 800→1250→1250 | |
| $B_2H_6$ [ppm] (relative to $SiH_4$) | 1500 | 1.25 | |
| NO [sccm] | 6.5 | | |
| $CH_4$ [sccm] | | | 751→848→1448→1527 |
| Internal pressure [mTorr] | 285 | 285→550→550 | |
| Power [w] | 160 | 320→700→700 | |
| Time [min] | 34 | Initial 10 + 350 | |

TABLE 31

| | Degreasing and cleaning steps | Rinsing step | Drying step | Synthetic evaluation results of black spot and image defect | Environmental characteristic |
|---|---|---|---|---|---|
| Addition of potassium silicate | ● | — | — | ○ | ○ |
| | — | ● | — | ○ | ○ |
| | — | — | ● | x | ○ |
| | ● | ● | — | ○ | ○ |
| | ● | — | ● | ○ | ○ |
| | — | ● | ● | ○ | ○ |
| | ● | ● | ● | ○ | ○ |
| Comparative experiment B1 | — | — | — | x | ○ |
| Comparative experiment B2 | — | — | — | ○ | x |

Note:
Symbol "●" denotes that an inhibitor (potassium silicate) is added, and symbol "—" denotes that no inhibitor is added.

From Table 31, preferable results were obtained by adding the inhibitor to a surface-active agent or immediately after the surface-active agent.

<Comparative Experiment B1>

Cleaning was performed in accordance with the same method as in the case of the experiment B1 except for a lack of inhibitor in the cleaning step, and thereafter an inhibiting-type electrophotographic photosensitive member was manufactured in accordance with the same method as in the case of the experiment B1 and evaluated similarly to the case of the experiment B1. Table 3 also shows the evaluation results of the comparative experiment B1.

<Comparative Experiment B2>

The same aluminum cylindrical substrate as in the case of the experiment B1 was used and its surface was cut and thereafter, the substrate was degreased and cleaned by the substrate-surface cleaner shown in FIG. 2 in accordance with the conditions in Table 32.

TABLE 32

| | Cleaning step |
|---|---|
| Treating agent | 1-1-1 trichloroethane |
| Temperature | 50° C. |
| Treating time | 3 min |
| Others | Ultrasonic treatment |

After cutting, the substrate 201 put on the mounting table 211 was carried to the cleaning bath 221 by the carrying mechanism 203. Then, the substrate 201 was cleaned by the trichloroethane (trade name: ETANA VG made by ASAHI CHEMICAL INDUSTRY CO., LTD.) 221 in the cleaning bath 221 to remove cutting oil and chips from the surface of the substrate 201.

After cleaning, the substrate 201 was carried to the conveying-out table 251 by the carrying mechanism 203.

Thereafter, an electrophotographic photosensitive member was manufactured in accordance with the same method as in the case of the experiment B1.

Table 31 also shows the result of evaluating the electrophotographic photosensitive member thus obtained in the comparative experiment B2 in accordance with the same method as in the case of the experiment B2. Thus, when an inhibitor (silicate) is contained in at least either of the degreasing and cleaning step and the rinsing step, the result shows that the performance of the electrophotographic photosensitive member is preferable.

<Experiment B2>

An inhibiting-type electrophotographic photosensitive member was formed on a substrate in accordance with the same method as in the case of the experiment B1 except for using the water shown in Table 33 in the rising and drying steps shown in Table 29 of the experiment B1, and thereafter evaluated in accordance with the same method as in the case of the experiment B1. Table 34 shows the evaluation results.

As described above, when an inhibitor (silicate) is contained in at least either of the degreasing-cleaning step and the rinsing step, the result shows that the performance of the electrophotographic photosensitive member is preferable.

TABLE 33

| | | Rinsing step | Drying step |
|---|---|---|---|
| Experiment B2 | (1) | Pure water (10 MΩ · cm) | Carbon-dioxide aqueous solution (18 μS/cm) |

TABLE 33-continued

| | Rinsing step | Drying step |
|---|---|---|
| (2) | Carbon-dioxide aqueous solution (18 μS/cm) | Pure water (10 MΩ · cm) |
| (3) | Carbon-dioxide aqueous solution (18 μS/cm) | Carbon-dioxide aqueous solution (18 μS/cm) |
| (4) | Pure water (10 MΩ · cm) | Pure water (10 MΩ · cm) |

TABLE 34

| | Degreasing and cleaning step | Rinsing step | Drying step | Synthetic evaluation results of black spot and image defect | Environmental characteristic |
|---|---|---|---|---|---|
| Addition of potassium silicate | ● | 1) — | — | ○ | ○ |
| | | 2) — | — | ○ | ○ |
| | | 3) — | — | ○ | ○ |
| | | 4) — | — | ○ | ○ |
| | — | 1) ● | — | ○ | ○ |
| | | 2) ● | — | ○ | ○ |
| | | 3) ● | — | ○ | ○ |
| | | 4) ● | — | ○ | ○ |
| | — | 1) — | ● | x | ○ |
| | | 2) — | ● | ○ | ○ |
| | | 3) — | ● | ○ | ○ |
| | | 4) — | ● | x | ○ |
| | ● | 1) ● | — | ○ | ○ |
| | | 2) ● | — | ○ | ○ |
| | | 3) ● | — | ○ | ○ |
| | | 4) ● | — | ○ | ○ |
| | ● | 1) — | ● | ○ | ○ |
| | | 2) — | ● | ○ | ○ |
| | | 3) — | ● | ○ | ○ |
| | | 4) — | ● | ○ | ○ |
| | — | 1) ● | ● | ○ | ○ |
| | | 2) ● | ● | ○ | ○ |
| | | 3) ● | ● | ○ | ○ |
| | | 4) ● | ● | ○ | ○ |
| | ● | 1) ● | ● | ○ | ○ |
| | | 2) ● | ● | ○ | ○ |
| | | 3) ● | ● | ○ | ○ |
| | | 4) ● | ● | ○ | ○ |

Note: Symbol "•" denotes that an inhibitor (potassium silicate) is added, and symbol "—" denotes that no inhibitor is added.

<Experiment B3>

When performing a treatment by using the same substrate as in the case of the experiment B1 and using a surface-active agent, changing water temperatures and treating times, applying or not applying the ultrasonic treatment, and changing the amount of the silicate serving as an inhibitor to be added in each of the degreasing and cleaning step, the rinsing step, and the drying step as shown in Table 35, types of the silicate to be introduced were changed as shown in Table 36. Thereafter, an inhibiting-type electrophotographic photosensitive member was formed on the substrate in accordance with the same method as in the case of the experiment B1 to perform the measurement in accordance with the same method as in the case of the experiment B1. Table 36 shows the measurement results.

TABLE 35

| Treating condition | Degreasing and cleaning step | Rinsing step | Drying step |
|---|---|---|---|
| Use of surface-active agent | Use of nonionic surface-active agent | Disuse of nonionic surface-active agent (10 MΩ · cm) | Disuse of nonionic surface-active agent (10 MΩ · cm) |
| Temperature | 40° C. | 25° C. | 25° C. |
| Treating time | 5 min | 1 min | 1 min |
| Ultrasonic treatment | Performed | Not performed | Not performed |
| Addition of inhibitor | ● | — | — |

Note:
Symbol ● denotes that an inhibitor is added, and symbol "—" denotes that no inhibitor is added.

TABLE 36

| | | Synthetic evaluation of black spot and image defect |
|---|---|---|
| Inhibitor | Potassium silicate | ◎ |
| | Sodium silicate | ○ |
| | Magnesium silicate | ○ |

As clearly shown in Table 36, preferable results were obtained even by using any type of silicate. Particularly, the most preferable result was obtained by potassium silicate.

<Experiment B4>

The same substrate as in the case of the experiment B1 was used and treated in accordance with the conditions shown in Table 35 similarly to the case of the experiment B3. In this case, the molar concentration of potassium silicate introduced was changed as shown in Table 37 to observe stains on the surface of the substrate after cleaned by the naked eye. Thereafter, an inhibiting-type electrophotographic photosensitive member was manufactured in accordance with the same method as in the case of the experiment B1 and evaluated in accordance with the same method as in the case of the experiment B1. Table 37 shows the evaluation results.

TABLE 37

| | | Potassium silicate concentration (%) | Appearance (Stain) | Synthetic evaluation results of black spot and image defect |
|---|---|---|---|---|
| Experiment 3 | (1) | $1 \times 10^{-6}$ | Δ | Δ |
| | (2) | $1 \times 10^{-5}$ | ○ | ○ |
| | (3) | $1 \times 10^{-4}$ | ◎ | ◎ |
| | (4) | $1 \times 10^{-3}$ | ◎ | ◎ |
| | (5) | $1 \times 10^{-2}$ | ◎ | ◎ |
| | (6) | $1 \times 10^{-1}$ | ○ | ○ |
| | (7) | 1 | Δ | ◎ |

Note:
The concentration unit of potassium silicate is the molar concentration (mol/l) with respect to water.

From the results in Table 37, preferable results were obtained in the molar concentration range of water-soluble potassium silicate of $10^{-6}$ to $10^{0}$. More preferable results were obtained in the molar concentration range of water-soluble potassium silicate of $10^{-5}$ to $10^{-1}$. Most preferable results were obtained in the molar concentration range of water-soluble potassium silicate of $10^{-4}$ to $10^{-2}$.

<Experiment B5>

By using an aluminum substrate in which the contents of Si was changed as shown in Table 38, degreasing and cleaning were performed in accordance with the same method as in the case of the experiment B1. Thereafter, the same inhibiting-type electrophotographic photosensitive member as the case of the experiment B1 was manufactured and evaluated similarly to the case of the experiment B1. Table 38 shows the evaluation results.

TABLE 38

| | | Si content (wt. %) | Synthetic evaluation results of black spot and image defect |
|---|---|---|---|
| Experiment B5 | (1) | 0.001 | ○ |
| | (2) | 0.002 | ◎ |
| | (3) | 0.03 | ◎ |
| | (4) | 0.07 | ◎ |
| | (5) | 0.42 | ◎ |
| | (6) | 0.63 | ◎ |
| | (7) | 0.99 | ◎ |
| | (8) | 1.0 | ○ |
| | (9) | 1.15 | Δ |

As clearly shown in Table 38, the present invention is effective even when the content of Si contained in an Al substrate is changed in a range of 0.001 wt. %≦Si≦1 wt. %.

<Experiment B6>

An inhibiting-type electrophotographic photosensitive member was manufactured in accordance with the same method as in the case of the experiment B5 except for changing the content of Fe contained in an A1 substrate, and evaluated similarly to the case of the experiment B5. Table 39 shows the evaluation results.

TABLE 39

| | | Fe content (wt. %) | Synthetic evaluation results of black spot and image defect |
|---|---|---|---|
| Experiment B6 | (1) | 0.001 | ○ |
| | (2) | 0.002 | ◎ |
| | (3) | 0.03 | ◎ |
| | (4) | 0.07 | ◎ |
| | (5) | 0.42 | ◎ |
| | (6) | 0.63 | ◎ |
| | (7) | 0.92 | ◎ |
| | (8) | 1.0 | ○ |
| | (9) | 1.15 | Δ |

As clearly shown in Table 39, preferable results were shown when the content of Fe contained in the Al substrate is a range of 0.01 wt. % ≦Fe≦1 wt. %.

<Experiment B7>

An inhibiting-type electrophotographic photosensitive member was manufactured in accordance with the same method as the case of the experiment B5 except for changing the content of Cu in an Al substrate, and evaluated similarly to the case of the experiment B5. Table 40 shows the evaluation results.

TABLE 40

| | | Cu content (wt. %) | Synthetic evaluation results of black spot and image defect |
|---|---|---|---|
| Experiment B7 | (1) | 0.001 | ○ |
| | (2) | 0.002 | ◎ |
| | (3) | 0.03 | ◎ |

TABLE 40-continued

| | | Cu content (wt. %) | Synthetic evaluation results of black spot and image defect |
|---|---|---|---|
| | (4) | 0.07 | ◎ |
| | (5) | 0.42 | ◎ |
| | (6) | 0.63 | ◎ |
| | (7) | 0.92 | ◎ |
| | (8) | 1.0 | ○ |
| | (9) | 1.15 | Δ |

As shown in Table 40, preferable results were shown when the content of Cu contained in an Al substrate ranges between 0.001 wt. % and 1.0 wt. % both inclusive.

<Experiment B8>

By using an aluminum substrate obtained by changing the content of Si, Fe and Cu contained in an Al substrate as shown in Table 38, degreasing and cleaning were performed in accordance with the same method as in the case of the experiment B1. Thereafter, the same inhibiting-type electrophotographic photosensitive member as in the case of the experiment B1 was manufactured and evaluated similarly to the case of the experiment B1. Table 41 shows the evaluation results.

TABLE 41

| | | Si, Fe and Cu contents (wt. %) | | | Synthetic evaluation results of black spot and image defect |
|---|---|---|---|---|---|
| | | Si | Fe | Cu | |
| Experiment B8 | 1) | 0.005 | 0.002 | 0.003 | ○ |
| | 2) | 0.004 | 0.003 | 0.004 | ◎ |
| | 3) | 0.005 | 0.01 | 0.01 | ◎ |
| | 4) | 0.01 | 0.003 | 0.02 | ◎ |
| | 5) | 0.02 | 0.001 | 0.05 | ◎ |
| | 6) | 0.1 | 0.01 | 0.05 | ◎ |
| | 7) | 0.2 | 0.3 | 0.01 | ◎ |
| | 8) | 0.3 | 0.4 | 0.3 | ◎ |
| | 9) | 0.4 | 0.4 | 0.3 | ○ |

As clearly shown in Table 41, the present invention is also effective when the total content of Si, Fe and Cu in an Al substrate is in a range of 0.01 wt. %<Si+Fe+Cu≦1 wt. %.

<Experiment B9>

By using the same substrate as in the case of the experiment B1 and changing treating temperatures and treating times in accordance with the conditions shown in Table 42 to change the thickness of a film, the same inhibiting-type electrophotographic photosensitive member as in the case of the experiment B1 was manufactured and evaluated similarly to the case of the experiment B1. Table 43 shows the evaluation results.

As clearly shown in Table 43, it is found that the thickness of the film formed on the substrate is preferably 5 Å to 150 Å both inclusive.

TABLE 42

| | Degreasing and cleaning step | Rinsing step | Drying step |
|---|---|---|---|
| Cleaning condition | Nonionic surface-active agent | Pure water (10 MΩ · cm) | Carbon-dioxide aqueous solution (20 μS/cm) |

TABLE 42-continued

| | Degreasing and cleaning step | Rinsing step | Drying step |
|---|---|---|---|
| Temperature | Changed | 25° C. | 45° C. |
| Treating time | Changed | 3 min | 1 min |
| Inhibitor | Potassium silicate | — | — |

TABLE 43

| | | Film thickness (Å) | Synthetic evaluation results of black spot and image defect |
|---|---|---|---|
| Experiment B9 | (1) | 3 | ○ |
| | (2) | 5 | ◎ |
| | (3) | 15 | ◎ |
| | (4) | 25 | ◎ |
| | (5) | 40 | ◎ |
| | (6) | 60 | ◎ |
| | (7) | 80 | ◎ |
| | (8) | 100 | ◎ |
| | (9) | 120 | ◎ |
| | (10) | 150 | ◎ |
| | (11) | 170 | ○ |

<Experiment B10>

A film was formed in accordance with the conditions shown in Table 44 by using the same substrate as in the case of the experiment B1 and changing treating temperatures and treating times in accordance with the conditions shown in Table 44 to change composition ratios of Si and O with respect to Al. Thereafter, the same inhibiting-type electrophotographic photosensitive member as in the case of the experiment B1 was manufactured and evaluated. Table 45 shows the evaluation results. The then composition ratios are values measured by the XPS method shown in the experiment B1.

TABLE 44

| | Degreasing and cleaning step | Rinsing step | Drying step |
|---|---|---|---|
| Cleaning condition | Nonionic surface-active agent | Pure water (10 MΩ · cm) | Carbon dioxide aqueous solution (20 μS/cm) |
| Temperature | Changed | 25° C. | 45° C. |
| Treating time | Changed | 3 min | 1 min |
| Film thickness | 70 Å | — | — |
| Inhibitor | Potassium silicate | — | — |

TABLE 45

| | | O content | | | | | |
|---|---|---|---|---|---|---|---|
| | | 0.5 | 1 | 3 | 5 | 8 | 10 |
| Si content | 0.05 | ○ | ○ | ○ | ○ | ○ | ○ |
| | 0.1 | ○ | ◎ | ◎ | ◎ | ○ | ○ |
| | 0.3 | ○ | ◎ | ◎ | ◎ | ○ | ○ |
| | 0.5 | ○ | ◎ | ◎ | ◎ | ○ | ○ |
| | 0.8 | ○ | ◎ | ◎ | ◎ | ○ | ○ |

TABLE 45-continued

| | O content | | | | | |
|---|---|---|---|---|---|---|
| | 0.5 | 1 | 3 | 5 | 8 | 10 |
| 1.0 | ○ | ◎ | ◎ | ◎ | ○ | ○ |
| 1.2 | ○ | ○ | ○ | ○ | ○ | ○ |

Preferable results were obtained in an Si range of 0.1 to 1.0 both inclusive and in an 0 range of 1 to 5 both inclusive.

<Experiment B11>

The same substrate as in the case of the experiment B1 was used and degreased and cleaned in accordance with the conditions shown in Table 46. Thereafter, blowing pressures used for cleaning (rinsing) were changed. Then, the same inhibiting-type electrophotographic photosensitive member as in the case of the experiment B1 was manufactured and evaluated. Table 47 shows the evaluation results.

<Observation and evaluation of appearance>

By reflecting strong exposure light on the surface of a cleaned substrate, stains on the substrate and the roughness of the substrate surface were evaluated by the naked eye.

◎: Very good

○: Good

Δ: No problem on practical use

TABLE 46

| Treating condition | Degreasing and cleaning step | Cleaning (rinsing) step | Drying step |
|---|---|---|---|
| Treating agent | Nonionic surface-active agent | Pure water (10 MΩ · cm) | Pure water (10 MΩ · cm) |
| Blowing pressure | | Changed | |
| Temperature | 40° C. | 25° C. | 45° C. |
| Treating time | 5 min | 1 min | 1 min |
| Others | Ultrasonic treatment | — | — |
| Inhibitor | ● | — | — |

Note:
Symbol "●" denotes that an inhibitor is added.

TABLE 47

| | | Pressure (kg · f/cm$^2$) | Synthetic evaluation results of black spot and image defect |
|---|---|---|---|
| Experiment B11 | (1) | 1 | Δ |
| | (2) | 2 | ○ |
| | (3) | 5 | ○ |
| | (4) | 10 | ○ |
| | (5) | 20 | ◎ |
| | (6) | 50 | ◎ |
| | (7) | 100 | ◎ |
| | (8) | 150 | ◎ |
| | (9) | 200 | ○ |
| | (10) | 250 | ○ |
| | (11) | 300 | ○ |
| | (12) | 310 | Δ |

As clearly shown in Table 47, were preferable results were obtained in a range of 2 to 300 kg·f/cm$^2$, particularly in a range of 20 to 150 kg·f/cm$^2$.

Hereafter, the present invention is described in more detail by example.

<Example A1>

The surface of a cylindrical substrate made of aluminum containing 0.06 wt. % of Si, 0.02 wt. % of Fe, and 0.02 wt. % of Cu and having a diameter of 108 mm, a length of 358 mm, and a thickness of 5 mm was cut in accordance with the same procedure as in the above-mentioned electrophotographic photosensitive member manufacturing method of the present invention. When 15 min passed after the cutting step was completed, the substrate was cleaned by the cleaner shown in FIG. 1 in accordance with the conditions shown in Table 48, and thereafter an inhibiting-type electrophotographic photosensitive member having the layer structure shown in FIG. 6A was manufactured on the substrate by the deposited-film forming apparatus shown in FIG. 3 in accordance with the conditions in Table 49.

Electrophotographic characteristics of the electrophotographic photosensitive member thus obtained were evaluated as shown below. In this case, however, every ten photosensitive members manufactured under the same film-forming conditions were evaluated.

TABLE 48

| Treating condition | Degreasing step | Cleaning step | Drying step |
|---|---|---|---|
| Treating agent | Nonionic surface-active agent | Carbon dioxide aqueous solution (20 $\mu$S/cm) | Pure water (10 MΩ · cm) |
| Temperature | 40° C. | 25° C. | 40° C. |
| Treating time | 5 min | 1 min | 1 min |
| pH | 10.5 | — | — |
| Potassium silicate | — | | |
| Other conditions | Ultrasonic treatment | — | — |

TABLE 49

| | Charge-injection inhibiting layer | Photoconductive layer | Surface layer |
|---|---|---|---|
| Type of gas and flow rate | | | |
| $SiH_4$ [sccm] | 400 | 400→460→460 | 186→169→30→25 |
| $H_2$ [sccm] | 800 | 800→2300→2300 | |
| $B_2H_6$ [ppm] (relative to $SiH_4$) | 1500 | 1.3 | |
| NO [sccm] | 14 | — | |
| $CH_4$ [sccm] | — | — | 751→848→1448→1527 |
| Internal pressure [mTorr] | 285 | 285→550→550 | 300→450 |
| Power [W] | 320 | 320→800→800 | 250 |
| Time [min] | 68 | Initial 10 + 350 | 31 |
| Change rate | | | |
| $SiH_4$ | | 0.4 sccm/sec | |
| $H_2$ | | 2.9 sccm/sec | |
| RF Power | | 0.9 W/sec | |
| Internal pressure | | 0.44 mTorr/sec | |

The peeling off of the film on the appearance of the obtained electrophotographic photosensitive member was observed by the naked eye and evaluated. Thereafter, the photosensitive member was set in a copying machine obtained by modifying the copying machine NP6060 manufactured by CANON for experiments in which the process speed was optionally changed in a range of 200 to 800 mm/sec for experiments and corona charging was generated by applying a voltage of 6 to 7 kV to a charger, to form an image on a transfer paper in accordance with the normal copying process and evaluate image characteristics.

Table 50 shows these evaluation results.

Image evaluation was performed in accordance with the following method. Moreover, as in comparative example A1, the substrate was treated in accordance with the method shown in the comparative experiment A2, and thereafter the same inhibiting-type electrophotographic photosensitive member as in the case of the example A1 was manufactured and evaluated in accordance with the same method as in the case of the example A1. Table 50 shows the evaluation results.

[Evaluation of image defect]

An image sample on which most image defects appeared was selected from the image samples obtained when setting an entire-surface half-tone manuscript and a character manuscript on a manuscript table to copy them by changing process speeds, and the image sample was evaluated. The evaluation was performed by observing the number of white points present on the same area on the surface of the image sample with a magnifying glass.

◎: Good

○: There are some very small white points.

Δ: Though very small white points are found on the entire surface, there is no trouble in recognizing characters.

x: Because there are many white points, there are some portions on which characters cannot be easily read.

[Evaluation of black stain]

An image was output so that the average density of images obtained when changing process speeds and setting an entire-surface half-tone manuscript on a manuscript table was kept within 0.4±0.1. An image sample having the most noticeable stain was selected out of the image samples thus obtained and evaluated. These images were observed at a position of 40 cm from observer's eyes to check if black stains are found, and the evaluation was performed in accordance with the following criteria.

◎: No black stain is found on any copy.

○:There are some copies having slight black stains. However, there is no problem because they are small.

Δ: Black stains are found on every copy. However, there is no problem in practical use because they are small.

x: Black stains are found on every copy.

[Evaluation of electrophotographic characteristic 1]

The surface potential of a photosensitive member obtained at a developing position when applying the same charging voltage at a normal process speed is evaluated as a charging ability in accordance with a relative value. In this case, the charging ability of the electrophotographic photosensitive member obtained from comparative example A1 is regarded as 100%.

[Evaluation of electrophotographic characteristic 2]

The luminous energy obtained when a charging voltage lowers to a certain potential by applying light after applying the same charging voltage at a normal speed is evaluated as a sensitivity in accordance with a relative value. In this case, the charging ability of the electrophotographic photosensitive member obtained from the comparative example 1 is regarded as 100%.

TABLE 50

| | Image defect | Black stain | Electro-photographic character-istic 1 | Electro-photographic character-istic 2 |
|---|---|---|---|---|
| Example A1 | ◎ | ◎ | 125% | 118% |
| Compara-tive Example A1 | ○ | ○ | 100% | 100% |

As shown in Table 50, very preferable results were shown and an unexpected advantage that electrophotographic characteristics were improved could be obtained.

<Example A2>

The same substrate as in the case of the example A1 was used and an inhibiting-type electrophotographic photosensitive member manufactured in accordance with the same method as in the case of the example A1 was evaluated in accordance with the method shown below. Table 51 shows the evaluation results. Moreover, as the comparative example A2, the substrate was treated in accordance with the method shown in the comparative experiment example A2 and thereafter, an inhibiting-type electrophotographic photosensitive member was manufactured and evaluated in accordance with the same method as the case of the example 1. Table 51 shows the evaluation results.

[Evaluation of image unevenness]

By setting an A3-size grid sheet (made by KOKUYO CO., LTD.) on the manuscript table of a copying machine, and changing diaphragm values of the copying machine and thereby changing manuscript exposure values so that an image in a range from a degree in which a graph line can be barely recognized up to a degree in which a white-background portion is about to be fogged, ten copies having different densities were output.

These images were observed at a position of 40 cm from the observer's eyes to check if densities are different from each other to evaluate them in accordance with the following criteria.

◎: No image unevenness is found on any copy.

○: There are some copies on which image unevenness is found and no image unevenness is found. However, there is no problem because image unevenness is slight.

Δ: Image unevenness is found on all copies. However, there is no trouble in practical use because the image unevenness at least one copy is slight.

x: Black stains are found on all copies.

[Evaluation of fogging of white background]

An image sample obtained when setting a normal manuscript whose white background is entirely covered with characters on a manuscript table and copying it was observed, and fogging on the white background was evaluated.

◎: Good

○: Slight fogging is locally found.

Δ: Though fogging is found on the entire surface, there is no trouble in recognizing characters.

x: There are portions where it is difficult to read characters because of fogging.

TABLE 51

| | Image unevenness | Fogging of white background |
|---|---|---|
| Example 2 | ◎ | ◎ |
| Comparative-Example 2 | ○ | ○ |

As clearly shown in Table 51, preferable results were obtained.

<Example A3>

Figure 6B:
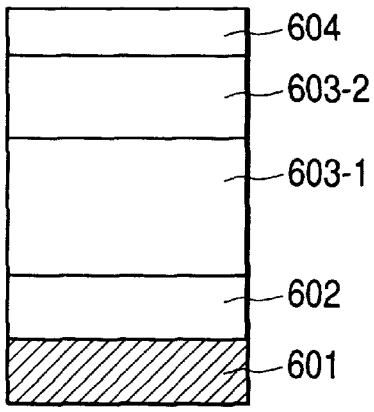

The same substrate in as the case of the example A1 was used to treat the surface of the substrate in accordance with the same method as in the case of the example Al. Thereafter, the inhibiting-type electrophotographic photosensitive member shown in FIG. 6B was manufactured in accordance with the conditions shown in Table 52 by the μwPCVD apparatus 400 shown in FIGS. 4A and 4B and evaluated in accordance with the same method as in the case of the example A1. Table 53 shows the evaluation results. Moreover, as a comparative example A3, the substrate was treated in accordance with the same method as in the case of the comparative experiment A2, and then the same inhibiting-type electrophotographic photosensitive member as in the example A3 was manufactured and evaluated in accordance with the same method as in the case of the example A3. Table 52 shows the evaluation results. In FIG. 6B, numeral 601 denotes an aluminum substrate, 602 denotes a charge-injection-inhibiting layer, 603-1 denotes a charge transporting layer, 603-2 denotes a charge generating layer, and 604 denotes a surface layer.

Figure 4A:
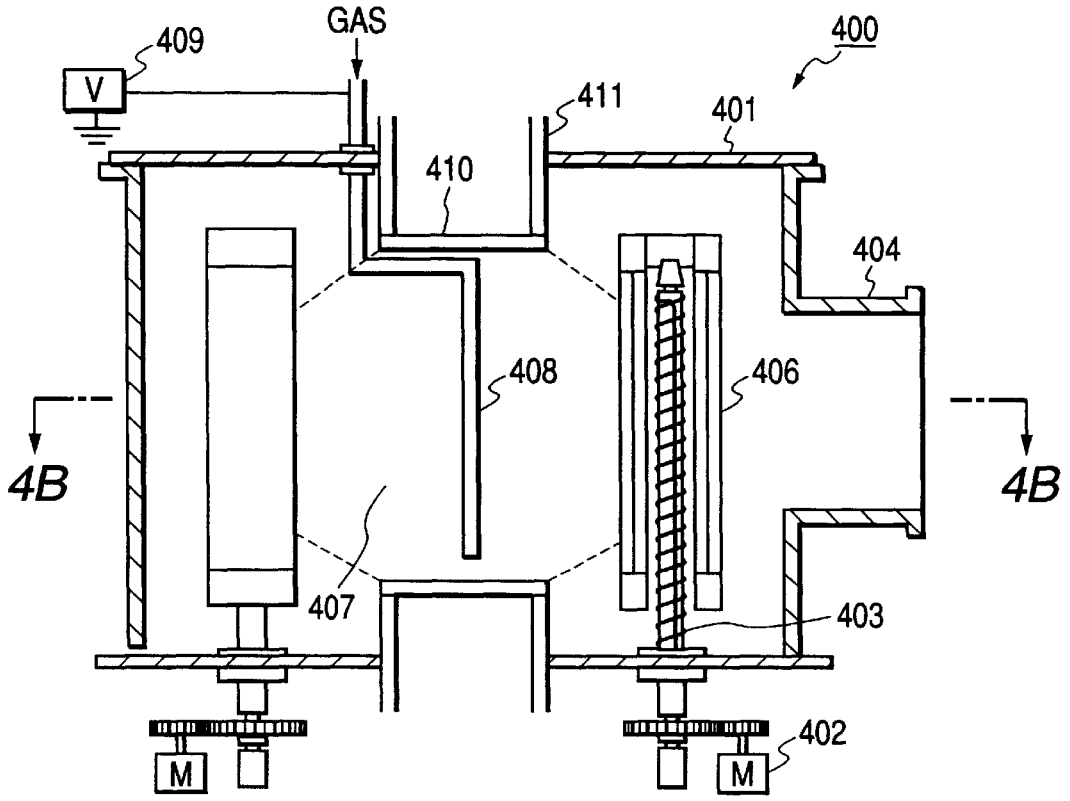
Figure 4B:
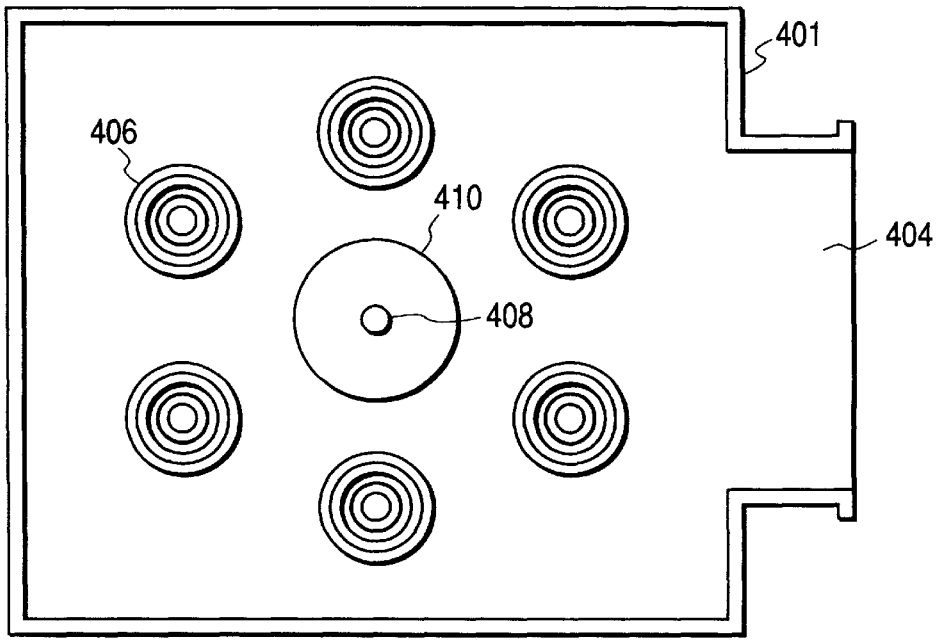

Moreover, in FIGS. 4A and 4B, symbol 401 denotes a deposition chamber, 402 denotes driving means (e.g. motor) for rotating a substrate 406, 403 denotes a heater, 404 denotes an exhaust pipe, 407 denotes a plasma region, 408 denotes a source gas-introducing pipe serving as a bias rod, 409 denotes a bias power supply, 410 denotes a microwave introduction window, and 411 denotes a microwave guide.

A source gas introduced into the deposition chamber 401 is made plasma by the microwave energy introduced through the microwave introduction window 410 in a region surrounded by the substrate 406. The substrate 406 is rotated and a deposited film is formed.

TABLE 52

| | Charge-injection inhibiting layer | Charge-transport-ing layer | Charge-genera-ting layer | Surface layer |
|---|---|---|---|---|
| Source-gas flow rate | | | | |
| $SiH_4$ [sccm] | 380 | 380 | 380 | 80 |
| He [sccm] | 108 | 108 | 108 | 114 |
| $CH_4$ [sccm] | 38 | 38 | 38 | 400 |
| $B_2H_6$ [ppm] | 1000 | 0 | 0 | 0 |
| Pressure [mTorr] | 11 | 11 | 10 | 12 |
| Microwave power [W] | 1000 | 1000 | 1000 | 1000 |
| Bias voltage [V] | 100 | 100 | 100 | 100 |
| Layer thickness [μm] | 3 | 20 | 5 | 0.5 |

TABLE 53

| | Image defect | Black stain | Electrophotographic characteristic 1 | Electrophotographic characteristic 2 |
|---|---|---|---|---|
| Example 3 | ⊙ | ⊙ | 130% | 119% |
| Comparative Example 3 | ○ | ○ | 100% | 100% |

As clearly shown in Table 53, the present invention is effective even when apparatuses and layer structures are different.

<Example A4>

The same substrate as in the case of the example A1 was used to perform the same surface treatment as in the case of the example A1. Thereafter, an inhibiting-type electrophotographic photosensitive member having the layer structure shown in FIG. 6A was manufactured by the VHFPCVD apparatus 520 shown in FIG. 5 in accordance with the conditions shown in Table 54 and evaluated similarly to the case of the example A1. As a result, the same preferable results as those in the example A1 were obtained.

Figure 5:
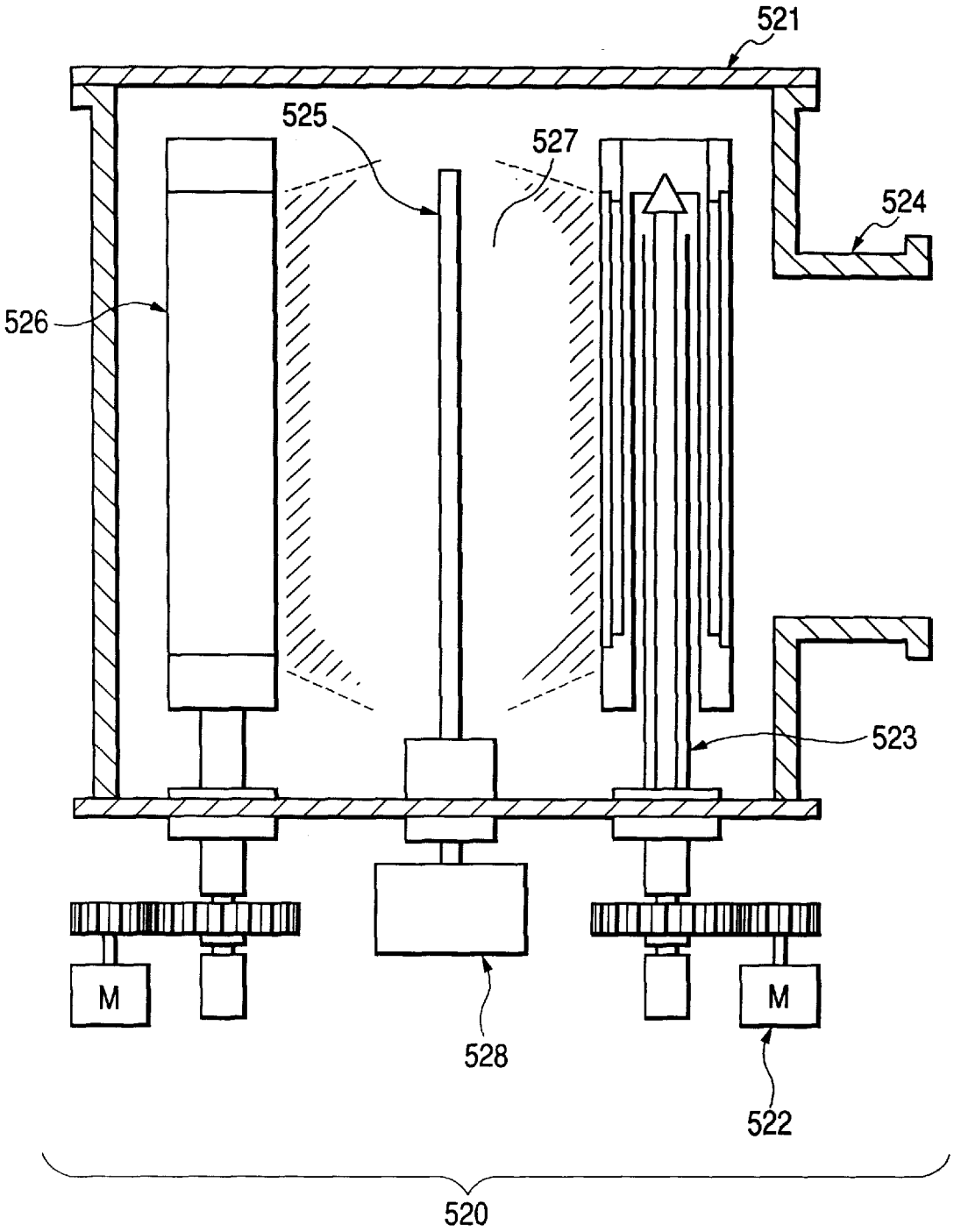

In FIG. 5, numeral 521 denotes a deposition chamber, 522 denotes driving means (e.g. motor) for rotating a substrate 526, 523 denotes a heater, 524 denotes an exhaust pipe, 525 denotes an electrode, 527 denotes a plasma region, and 528 denotes a VHF power supply.

The apparatus shown in FIG. 5 makes a source gas plasma with VHF-wave energy to form a deposited film on a substrate.

TABLE 54

| | Charge injection inhibiting layer | Photoconductive layer | Surface layer |
|---|---|---|---|
| Type of gas and flow rate | | | |
| $SiH_4$ [sccm] | 200 | 200→250 | 200→10→10 |
| $H_2$ [sccm] | 660 | 660→1000 | — |
| $B_2H_6$ [ppm] (relative to $SiH_4$) | 1500 | 3 | — |
| NO [sccm] | 10 | — | — |
| $CH_4$ [sccm] | — | — | 0→500→500 |
| $SiF_4$ [sccm] | — | — | 10→0 |
| Internal pressure [mTorr] | 30 | 30→10 | 300→450 |
| Power [W] | 200 | 200→700 | 250 |
| Layer thickness [μm] | 2.5 | 28 | 0.5 |
| Change rate | | | |
| $SiH_4$ | | 0.4 sccm/sec | |
| $H_2$ | | 2.9 sccm/sec | |
| RF Power | | 0.9 W/sec | |
| Internal pressure | | 0.44 mTorr/sec | |

<Example A5>

The surface of a cylindrical substrate made of aluminum containing 0.05 wt. % of Si, 0.03 wt. % of Fe, and 0.02 wt. % of Cu and having a diameter of 108 mm, a length of 358 mm, and a thickness of 5 mm was cut in accordance with the same procedure as an example of the procedure of the above-mentioned electrophotographic photosensitive member-manufacturing method of the present invention, and then degreased, roughened, and cleaned (rinsed) by the roughening apparatus shown in FIG. 7 in accordance with the conditions shown in Table 55 when 15 min passed after the cutting step was completed. Thereafter, the substrate was cleaned in accordance with the conditions shown in Table 56, and then an inhibiting-type electrophotographic photosensitive member having the layer structure shown in FIG. 6A was manufactured on the substrate by the deposited-film forming apparatus shown in FIG. 3 in accordance with the conditions in Table 57.

The electrophotographic characteristics of the electrophotographic photosensitive member thus obtained were evaluated as shown below. In this case, every ten photosensitive members manufactured under the same film-forming conditions were evaluated.

TABLE 55

| Treating condition | Roughening step | |
|---|---|---|
| Treating agent | Detergent aqueous solution (Nonionic surface-active agent) | Pure water (10 MΩ · cm) |
| Temperature | 40° C. | 25° C. |
| Treating time | 5 min | 3 min |
| Inhibitor | Potassium silicate (3 g/l) | — |
| D/R | 0.06 | — |
| pH | 10.5 | — |

TABLE 56

| Treating condition | Cleaning step 1 | Cleaning step 2 | Drying step |
|---|---|---|---|
| Treating agent | Nonionic surface-active agent | Pure water (10 MΩ · cm) | Pure water (10 MΩ · cm) |
| Temperature | 40° C. | 25° C. | 40° C. |
| Treating time | 5 min | 1 min | 1 min |
| pH | 10.5 | — | — |
| Other conditions | Ultrasonic treatment | — | — |

TABLE 57

| | Charge injection inhibiting layer | Photoconductive layer | Surface layer |
|---|---|---|---|
| Type of gas and flow rate | | | |
| $SiH_4$ [sccm] | 390 | 390→450→450 | 186→169→30→25 |
| $H_2$ [sccm] | 780 | 780→2250→2250 | |
| $B_2H_6$ [ppm] (relative to $SiH_4$) | 1500 | 1.3 | |
| NO [sccm] | 13 | — | |
| $CH_4$ [sccm] | — | — | 751→848→1448→1527 |
| Internal pressure [mTorr] | 285 | 285→550→550 | 300→450 |
| Power [W] | 320 | 320→800→800 | 250 |
| Time [min] | 68 | Initial 10 + 350 | 31 |

TABLE 57-continued

| | Charge injection inhibiting layer | Photo-conductive layer | Surface layer |
|---|---|---|---|
| Change rate | | | |
| $SiH_4$ | | 0.4 sccm/sec | |
| $H_2$ | | 2.9 sccm/sec | |
| RF Power | | 0.9 W/sec | |
| Internal pressure | | 0.44 mTorr/sec | |

The peeling off of the film on the surface of the obtained electrophotographic photosensitive member was observed by the naked eye. Then, the photosensitive member was set in the CANON-manufactured copying machine NP6650 modified so as to be able to optionally change the process speed in a range of 200 to 800 mm/sec for experiments, perform corona charging by applying a voltage of 6 to 7 kV to a charger, form a latent image on the electrophotographic photosensitive member surface with 788-nm laser image exposure light, and form an image on a transfer paper in accordance with a normal copying process. The image characteristic was evaluated. Table 58 shows the evaluation results.

Image evaluation was performed in accordance with the following method. Moreover, as a comparative example A4, the substrate was treated in accordance with the method shown in the comparative experiment A3 to manufacture the same inhibiting-type electrophotographic photosensitive member as in the case of the example A5, and evaluate it in accordance with the same method as the case of the example A5. Table 58 shows the evaluation results.

[Evaluation of image defect]

An image sample on which most image defects appeared was selected out of the image samples obtained when changing process speeds, setting an entire-surface half-tone manuscript and a character manuscript on a manuscript table and copying them, and the image sample was evaluated. The evaluation was performed by observing the surface of the image sample with a magnifying glass and counting the number of white points in the same area.

◎: Good

○: There are very small white points in a part of the surface.

Δ: Though very small white points are found on the entire surface, there is no trouble in recognizing characters.

x: Because of a lot of white points, there are portions where it is difficult to read characters.

[Evaluation of black stain]

An image was output so that the average density of images obtained by changing the process speed and setting an entire-surface half-tone manuscript on a manuscript table was kept at 0.4±0.1. An image sample having the most noticeable stain was selected from the image samples thus obtained and evaluated. The evaluation was performed in accordance with the following criteria by observing the image at a position of 40 cm from the observer's eyes to check if black stains are found.

◎: No black stain is found on any copy.

○: There are some images having slight black stains. However, there is no problem at all because the black stains are small.

Δ: Black stains are found on any copy. However, there is no trouble in practical use because the black stains are small.

x: Black stains are found on all copies.

[Evaluation of electrophotographic characteristic 1]

The surface potential of a photosensitive member obtained at a developing position when applying the same charging voltage at a normal process speed is evaluated as a charging ability with a relative value. In this case, the charging ability of the electrophotographic photosensitive member obtained from the comparative experiment A3 is regarded as 100%.

[Evaluation of electrophotographic characteristic 2]

The luminous energy obtained when the charging voltage lowers to a certain potential by applying light after the same charging voltage is applied at a normal speed, is evaluated as a sensitivity with a relative value. In this case, the charging ability of the electrophotographic photosensitive member obtained from the comparative experiment A2 is regarded as 100%.

[Evaluation of cost]

◎: Cost can be reduced (inexpensive).

○: Cost is equal to that of the prior art.

x . . . Cost may be increased.

TABLE 58

| | Image defect | Black stain | Electro-photographic characteristic 1 | Electro-photographic characteristic 2 | Cost |
|---|---|---|---|---|---|
| Example A5 | ◎ | ◎ | 130% | 120% | ◎ |
| Comparative example A4 | ○ | ○ | 100% | 100% | ○ |

As clearly shown in Table 58, more preferable results were shown and an unexpected advantage of improvement of electrophotographic characteristics could be obtained.

<Example A6>

An inhibiting-type electrophotographic photosensitive member was manufactured in accordance with the same method as in the case of the example A5 by using the same substrate as in the case of the example A5, and evaluated in accordance with the method shown below. Table 59 shows the evaluation results. Moreover, as a comparative example 5, the substrate was treated in accordance with the method shown in the comparative experiment A3 and thereafter an inhibiting-type electrophotographic photosensitive member was manufactured and evaluated in accordance with the same method as in the case of the example 5. Table 59 also shows the evaluation results.

[Evaluation of slipping characteristic]

By applying an optional load to a plate and using a piezoelectric element, forces for the plate to be pulled by a drum (i.e., frictional force) before and after start of rotation of the drum are detected. The "maximum static friction coefficient" was calculated from the load and the "maximum static frictional force" immediately before start of rotation, and similarly a "dynamic friction coefficient" was calculated from a "dynamic frictional force" during steady rotation. Both coefficients were compared as relative values when regarding the comparative experiment A3 as 100% (it is shown that the slipping characteristic is improved as the value is small).

[Evaluation of image unevenness]

By setting an A3-size grid sheet (made by KOKUYO CO., LTD.) on the manuscript table of a copying machine, and changing diaphragm values of the copying machine and thereby changing manuscript exposure values so that an image in a range from a degree in which a graph line can be barely recognized up to a degree in which a white-background portion is about to be fogged, ten copies having different densities were output.

These images were observed at a position of 40 cm from the observer's eyes to check if densities are different from each other and evaluate them in accordance with the following criteria.

⊙: No image unevenness is found on each copy.

○: Some copies having image unevenness are found, and the other copies having no image unevenness are found. However, there is no problem because image unevenness is slight.

Δ: Image unevenness is found on all copies. However, there is no trouble in practical use because the image unevenness on each copy is slight.

x: Black stains are found on all copies.

[Evaluation of fogging of white background]

An image sample obtained when setting a normal manuscript whose white background is entirely covered with characters on a manuscript table and copying it was observed and fogging on the white background was evaluated.

⊙: Good

○: Slight fogging is locally found.

Δ: Though fogging is found on the entire surface, there is no trouble in recognizing characters.

x . . . There are portions where it is difficult to read characters because of fogging.

TABLE 59

| | Slipping characteristic | Image unevenness | Fogging of white background |
|---|---|---|---|
| Example 6 | 120% | ⊙ | ⊙ |
| Comparative Example 5 | 100% | ○ | ○ |

As shown in Table 40, preferable results were obtained.

<Example A7>

The same substrate as in the case of the example A5 was used to treat the surface of the substrate in accordance with the same method as in the case of the example A5. Thereafter, the inhibiting-type electrophotographic photosensitive member shown in FIG. 6B was manufactured in accordance with the conditions shown in Table 60 by the μwPCVD apparatus shown in FIGS. 4A and 4B and evaluated in accordance with the same method as in the case of the example A5. Table 61 shows the evaluation results. Moreover, as comparative example A6, the substrate was treated in accordance with the same method as in the case of the comparative experiment A3, and then the same inhibiting-type electrophotographic photosensitive member was manufactured and evaluated in accordance with the same method as in the case of the example A7. Table 61 shows the evaluation results. In FIG. 6B, numeral 601 denotes an aluminum substrate, 602 denotes a charge-injection inhibiting layer, 603-1 denotes a charge transporting layer, 603-2 denotes a charge generating layer, and 604 denotes a surface layer.

TABLE 60

| | Charge-injection inhibiting layer | Charge-transporting layer | Charge-generating layer | Surface layer |
|---|---|---|---|---|
| Source-gas flow rate | | | | |
| $SiH_4$ [sccm] | 350 | 350 | 350 | 70 |
| He [sccm] | 100 | 100 | 100 | 100 |
| $CH_4$ [sccm] | 35 | 35 | 35 | 350 |
| $B_2H_6$ [ppm] | 1000 | 0 | 0 | 0 |
| Pressure [mTorr] | 11 | 11 | 10 | 12 |
| Microwave power [W] | 1000 | 1000 | 1000 | 1000 |
| Bias voltage [V] | 100 | 100 | 100 | 100 |
| Layer thickness [μm] | 3 | 20 | 5 | 0.5 |

TABLE 61

| | Image defect | Black stain | Electrophotographic characteristic 1 | Electrophotographic characteristic 2 | Cost |
|---|---|---|---|---|---|
| Example A7 | ⊙ | ⊙ | 128% | 121% | ⊙ |
| Comparative Example A6 | ○ | ○ | 100% | 100% | ○ |

As clearly shown in Table 61, the present invention is effective even when apparatuses and layer structures are different.

<Example A8>

The same substrate as in the case of the example A5 was used to perform the same surface treatment as in the case of the example A5. Thereafter, an inhibiting-type electrophotographic photosensitive member having the layer structure shown in FIG. 6A was manufactured by the VHFPCVD apparatus shown in FIG. 5 in accordance with the conditions shown in Table 62 and evaluated similarly to the case of the example A5. As a result, the same preferable results as those of the example A5 were obtained.

TABLE 62

| | Charge injection inhibiting layer | Photoconductive layer | Surface layer |
|---|---|---|---|
| Type of gas and flow rate | | | |
| $SiH_4$ [sccm] | 150 | 150→200 | 200→10→10 |
| $H_2$ [sccm] | 500 | 500→1000 | — |
| $B_2H_6$ [ppm] (relative to $SiH_4$) | 1500 | 3 | — |
| NO [sccm] | 10 | — | — |
| $CH_4$ [sccm] | — | — | 0→500→500 |
| $SiF_4$ [sccm] | — | — | 10→0 |
| Internal pressure [mTorr] | 30 | 30→10 | 300→450 |
| Power [W] | 200 | 200→800 | 250 |

TABLE 62-continued

| | Charge injection inhibiting layer | Photoconductive layer | Surface layer |
|---|---|---|---|
| Layer thickness [μm] | 2.5 | 28 | 0.5 |
| Change rate | | | |
| $SiH_4$ | | 0.4 sccm/sec | |
| $H_2$ | | 2.9 sccm/sec | |
| RF Power | | 0.9 W/sec | |
| Internal pressure | | 0.44 mTorr/sec | |

<Example B1>

The surface of a cylindrical substrate made of aluminum containing 0.05 wt. % of Si, 0.03 wt. % of Fe, and 0.02 wt. % of Cu and having a diameter of 108 mm, a length of 358 mm, and a thickness of 5 mm was cut in accordance with the same procedure as an example of the above-mentioned electrophotographic photosensitive member-manufacturing method of the present invention, and then degreased, rinsed, and dried in accordance with the conditions shown in Table 63 when 15 min passed after cutting was completed. Thereafter, an inhibiting-type electrophotographic photosensitive member having the layer structure shown in FIG. 6A was manufactured on the substrate by the deposited-film forming apparatus shown in FIG. 3 in accordance with the conditions in Table 64. In this case, an Al—Si—O film was formed in a composition of Al:Si:O=1:0.25:3 and a thickness of 75 Å.

Electrophotographic characteristics of the electrophotographic photosensitive member thus obtained were evaluated as shown below. In this case, every ten photosensitive members manufactured under the same film-forming condition were evaluated.

The peeling off of the film on the surface of the obtained electrophotographic photosensitive member was observed by the naked eye. Then, the photosensitive member was set in the CANON-manufactured copying machine NP6650 modified so as to be able to optionally change the process speed in a range of 200 to 800 mm/sec for experiments, perform corona charging by applying a voltage of 6 to 7 kV to a charger, form a latent image on the electrophotographic photosensitive member surface with 788-nm laser image exposure light, and form an image on a transfer paper. The image characteristic was evaluated.

TABLE 63

| Treating condition | Cleaning step 1 | Rinsing step 2 | Rinsing step 3 | Drying step |
|---|---|---|---|---|
| Treating agent | Nonionic surface-active agent | Pure water (10 MΩ · cm) | Pure water (10 MΩ · cm) | Pure water (10 MΩ · cm) |
| Temperature | 40° C. | 25° C. | 25° C. | 45° C. |
| Pressure (kg · f/cm$^2$) | — | — | 30 | — |
| Treating time | 5 min | 1 min | 1 min | 1 min |
| pH | 10.3 | — | — | — |
| Inhibitor | Potassium silicate (3 g/l) | — | — | — |

TABLE 63-continued

| Treating condition | Cleaning step 1 | Rinsing step 2 | Rinsing step 3 | Drying step |
|---|---|---|---|---|
| Other conditions | Ultrasonic treatment | — | — | — |

TABLE 64

| | Charge-injection inhibiting layer | Photo-conductive layer | Surface layer |
|---|---|---|---|
| Type of gas and flow rate | | | |
| $SiH_4$ [sccm] | 420 | 420→450→450 | 186→169→30→25 |
| $H_2$ [sccm] | 840 | 840→2250→2250 | |
| $B_2H_6$ [ppm] (relative to $SiH_4$) | 1500 | 1.3 | |
| NO [sccm] | 13 | — | |
| $CH_4$ [sccm] | — | — | 751→848→1448→1527 |
| Internal pressure [mTorr] | 285 | 285→550→550 | 300→450 |
| Power [W] | 320 | 320→800→800 | 250 |
| Time [min] | 68 | Initial 10 + 350 | 31 |

TABLE 65

| | Image defect | Black stain | Electro-photographic characteristic 1 | Electro-photographic characteristic 2 | Cost |
|---|---|---|---|---|---|
| Example B1 | ◎ | ◎ | 128% | 122% | ◎ |
| Comparative Example B1 | ○ | ○ | 100% | 100% | ○ |

Image evaluation was performed using the following four methods. Table 65 shows the evaluation results.

[Evaluation of image defect]

An image sample on which image defects appeared most was selected from the image samples obtained when setting an entire-surface half-tone manuscript and a character manuscript on a manuscript table and copying them by changing the process speed and evaluated. The evaluation was performed by observing the number of white points present on the same area on the surface of the image sample with a magnifying glass.

◎: Good

○: There are locally very small white points though they do not prevent characters from being read.

Δ: Though very small white points are found on the entire surface, there is no trouble in recognizing characters.

x: Because there are many white points, there are some portions on which characters cannot be easily read.

[Evaluation of black stain]

An image was output so that the average density of images obtained when changing process speeds and setting an entire-surface half-tone manuscript on a manuscript table was kept within 0.4±0.1. An image sample having the most noticeable stain was selected out of the image samples thus obtained and evaluated. These images were observed at a position of 40 cm from observer's eyes to check if black stains are found, and the evaluation was performed in accordance with the following criteria.

◎: No black stain is found on each copy.

○: There are some copies having slight stains. However, there is no problem because they are small.

Δ: Black stains are found on every copy. However, there is no problem in practical use because they are very small.

x: Black stains are found on every copy.

[Evaluation of electrophotographic characteristic 1]

The surface potential of a photosensitive member obtained at a developing position when applying the same charging voltage at a normal process speed is evaluated as a charging ability with a relative value. In this case, the charging ability of the electrophotographic photosensitive member obtained from the comparative experiment B2 is regarded as 100%.

[Evaluation of electrophotographic characteristic 2]

The luminous energy obtained when the charging voltage lowers to a certain potential by applying light after applying the same electrification voltage at a normal process speed is evaluated as a sensitivity with a relative value. In this case, the charging ability of the electrophotographic photosensitive member obtained from the conventional example 1 is regarded as 100%.

[Evaluation of cost]

◎: Cost can be reduced (inexpensive).

○: Cost is equal to that of the prior art.

x . . . Cost may be increased.

<Example B2>

The same substrate as in the case of the example B1 was used to manufacture an inhibiting-type electrophotographic photosensitive member in accordance with the same method as in the case of the example B1 and evaluate it. Table 66 shows the evaluation results. Moreover, as comparative example B2, the substrate was treated in accordance with the method shown in the comparative experiment B2 to manufacture an inhibiting-type electrophotographic photosensitive member. Image evaluation was performed in accordance with the following three methods. Table 66 shows the evaluation results.

TABLE 66

| | Slipping characteristic | Image unevenness | Fogging of white background |
|---|---|---|---|
| Example 2 | 121% | ◎ | ◎ |
| Comparative Example 2 | 100% | ○ | ○ |

[Evaluation of slipping characteristic]

By applying an optional load to a plate and using a piezoelectric element, forces for the plate to be pulled by a drum (i.e., frictional force) before and after the start of the rotation of the drum are detected. The "maximum static friction coefficient" was calculated from the load and the "maximum static frictional force" immediately before start of rotation, and similarly a "dynamic friction coefficient" was calculated from a "dynamic frictional force" under steady rotation. Both coefficients were compared using a relative value, when regarding the comparative example B2 as 100% (it is shown that the slipping characteristic is improved as the value is small).

[Evaluation of image unevenness]

By setting an A3-size grid sheet (made by KOKUYO CO., LTD.) on the manuscript table of a copying machine, and changing diaphragm values of the copying machine and thereby changing manuscript exposure values so that an image in a range from a degree in which a graph line can be barely recognized up to a degree in which a white-background portion is about to be fogged, ten copies having different densities were output.

These images were observed at a position of 40 cm from the observer's eyes to check if densities are different from each other and evaluate them with the following criteria.

◎: No image unevenness is found on each copy.

○: Some copies having image unevenness are found, and the other copies no image unevenness are found. However, there is no problem because image unevenness is slight.

Δ: Image unevenness is found on all copies. However, there is no trouble in practical use because the image unevenness on each copy is slight.

x: Image unevenness is found on all copies.

[Evaluation of fogging of white background]

An image sample obtained when setting a normal manuscript whose white background is entirely covered with characters on a manuscript table and copying it was observed and fogging on the white background was evaluated.

◎: Good

○: Slight fogging is locally found.

Δ: Though fogging is found on the entire surface, there is no trouble in recognizing characters.

x: There are portions where it is difficult to read characters because of fogging.

<Example B3>

The same substrate as in the case of the example B1 was used to treat the surface of the substrate in accordance with the same method as in the case of the example B1. Thereafter, the inhibiting-type electrophotographic photosensitive member shown in FIG. 6B was manufactured in accordance with the conditions shown in Table 67 by the microwave CVD apparatus (μwPCVD apparatus) shown in FIGS. 4A and 4B. The image evaluation was performed with respect to the above-described image defect, black stain, image photographic characteristic 1, and image photographic characteristic 2. Table 68 shows the evaluation results. Moreover, as in comparative example B3, the substrate was treated in accordance with the same method shown in the comparative experiment B2, and thereafter the same inhibiting-type electrophotographic photosensitive member as in the case of the example B3 was manufactured and evaluated in accordance with the same method as in the case of the example B3. Table 68 shows the evaluation results.

TABLE 67

| | Charge injection inhibiting layer | Charge-transporting layer | Charge generating layer | Surface layer |
|---|---|---|---|---|
| Source-gas flow rate | | | | |
| $SiH_4$ [sccm] | 360 | 360 | 360 | 70 |
| He [sccm] | 100 | 100 | 100 | 100 |
| $CH_4$ [sccm] | 40 | 40 | 40 | 350 |
| $B_2H_6$ [ppm] | 1000 | 0 | 0 | 0 |
| Pressure [mTorr] | 11 | 11 | 10 | 12 |
| Microwave power [W] | 1000 | 1000 | 1000 | 1000 |

TABLE 67-continued

| | Charge injection inhibiting layer | Charge-transporting layer | Charge generating layer | Surface layer |
|---|---|---|---|---|
| Bias voltage [V] | 100 | 100 | 100 | 100 |
| Layer thickness [μm] | 3 | 20 | 5 | 0.5 |

TABLE 68

| | Image defect | Black stain | Electrophotographic characteristic 1 | Electrophotographic characteristic 2 | Cost |
|---|---|---|---|---|---|
| Example B3 | ◎ | ◎ | 131% | 122% | ◎ |
| Comparative Example B3 | ○ | ○ | 100% | 100% | ○ |

As clearly shown in Table 68, the present invention is effective even when apparatuses and layer structures are different.

<Example B4>

The same substrate as in the case of the example B1 was used to perform the same surface treatment as in the case of the example B1. Thereafter, an inhibiting-type electrophotographic photosensitive member having the layer structure shown in FIG. 6B was manufactured by the VHF PCVD apparatus shown in FIG. 5 in accordance with the conditions shown in Table 69 and evaluated similarly to the case of the example B1. As a result, the same preferable results as those of the example B1 were obtained.

TABLE 69

| | Charge injection inhibiting layer | Photoconductive layer | Surface layer |
|---|---|---|---|
| Type of gas and flow rate | | | |
| $SiH_4$ [sccm] | 200 | 200→240 | 200→10→10 |
| $H_2$ [sccm] | 660 | 660960 | — |
| $B_2H_6$ [ppm] (relative to $SiH_4$) | 1500 | 3 | — |
| NO [sccm] | 10 | — | — |
| $CH_4$ [sccm] | — | — | 0→500→500 |
| $SiF_4$ [sccm] | — | — | 10→0 |
| Internal pressure [mTorr] | 30 | 30→10 | 300→450 |
| Power [W] | 200 | 200→800 | 250 |
| Layer thickness [μm] | 2.5 | 28 | 0.5 |
| Change rate | | | |
| $SiH_4$ | | 0.4 sccm/sec | |
| $H_2$ | | 2.9 sccm/sec | |
| RF Power | | 0.9 W/sec | |
| Internal pressure | | 0.44 mTorr/sec | |

As described above, according to the electrophotographic photosensitive member-manufacturing method of the present invention comprising the step of forming a functional film on an aluminum substrate by plasma CVD, wherein the surface of the substrate is cleaned with water containing a specific inhibitor before the step of forming a deposited film, it is possible to inexpensively and stably manufacture an electrophotographic photosensitive member capable of providing a uniform high-quality image.

Moreover, according to the electrophotographic photosensitive member-manufacturing method of the present invention comprising the step of forming a functional film on an aluminum substrate by plasma CVD, wherein the surface of the substrate is degreased with water containing a surface-active agent and a specific inhibitor and irregularity comprising a plurality of spherical trace dents is formed on the substrate surface before the step of forming the deposited film, it is possible to inexpensively and stably manufacture an electrophotographic photosensitive member capable of providing a uniform high-quality image.

Furthermore, according to the electrophotographic photosensitive member-manufacturing method of the present invention comprising the step of forming a functional film on an aluminum substrate, wherein an Al—Si—O film is formed on the surface of the substrate before the step of forming the functional film by using the water containing an inhibitor, the Al—Si—O film having a thickness in a range of not less than 5 Å and not more than 150 Å and a ratio of Al:Si:O=a:b:c provided that when a=1, $0.1 \leqq b \leqq 0.5$ and $1 \leqq c \leqq 5$. Therefore, it is possible to manufacture an electrophotographic photosensitive member capable of providing a uniform high-quality image at a low cost and a high yield.

What is claimed is:

1. A method of manufacturing an electrophotographic photosensitive member, which comprises the steps of: (a) setting an aluminum substrate to a substrate holder; (b) cleaning the surface of the aluminum substrate with water containing a silicate inhibitor; and (c) thereafter forming a functional film made of an amorphous material comprising silicon atoms as a matrix on the surface of the aluminum substrate by reduced-pressure vapor deposition.

2. The method according to claim 1, wherein the silicate is potassium silicate.

3. The method according to claim 1, wherein the concentration of the inhibitor contained in the water containing the inhibitor used in the cleaning step is not less than 0.05% and not more than 2%.

4. The method according to claim 1, wherein the step of forming the functional film on the aluminum substrate includes a step of forming a deposited film of non-single-crystal comprising silicon atoms and either or both of hydrogen atoms and fluorine atoms on an aluminum substrate by plasma CVD.

5. A method of manufacturing an electrophotographic photosensitive member, which comprises the steps of: (a) setting an aluminum substrate to a substrate holder; (b) forming irregularity comprising a plurality of spherical trace dents on the surface of the aluminum substrate; (c) degreasing the surface of the aluminum substrate with water containing a silicate inhibitor; and (d) thereafter forming a functional film made of an amorphous material comprising silicon atoms as a matrix on the surface of the aluminum substrate by reduced-pressure vapor deposition.

6. The method according to claim 5, wherein the irregularity is formed with dents having almost the same curvature and width.

7. The method according to claim 5, wherein the curvature R and width D of the dents of the irregularity take a value meeting a range of $0.035 \leqq D/R \leqq 0.5$.

8. The method according to claim 5, wherein the width of the dents is not less than 4 μm and not more than 500 μm.

9. The method according to claim 5, wherein the inhibitor used in the step of forming the irregularity is potassium silicate.

10. The method according to claim 5, wherein the method further comprises a step of cleaning the surface of the substrate with any one of a surface-active agent, pure water, water containing carbon dioxide, and water containing an inhibitor as a specific component, or combination of two or more thereof after the step of forming the plurality of spherical trace dents on the surface of the substrate.

11. The method according to claim 10, wherein the cleaning step after the step of forming the irregularity comprising the plurality of spherical trace dents on the surface of the substrate includes a step of drying the substrate by raising from any one of hot pure water, hot pure water containing carbon dioxide, and hot pure water containing an inhibitor as a specific component, or combination thereof.

12. The method according to claim 5, wherein the step of forming the functional film on the aluminum substrate includes a step of forming a deposited film of non-single-crystal comprising silicon atoms and either or both of hydrogen atoms and fluorine atoms on an aluminum substrate by plasma CVD.

13. The method according to claim 1, wherein the aluminum substrate is an aluminum substrate having a total content of Fe+Si+Cu exceeding 0.01 wt. % and not more than 1 wt. %.

14. The method according to claim 13, wherein the aluminum substrate is an aluminum substrate having a content of Fe not less than 10 ppm and not more than 1 wt. %.

15. The method according to claim 13, wherein the aluminum substrate is an aluminum substrate having a content of Si not less than 10 ppm and not more than 1 wt. %.

16. The method according to claim 13, wherein the aluminum substrate is an aluminum substrate having a content of Cu not less than 10 ppm and not more than 1 wt. %.

17. The method according to claim 5, wherein the aluminum substrate is an aluminum substrate having a total content of Fe+Si+Cu exceeding 0.01 wt. % and not more than 1 wt. %.

18. The method according to claim 17, wherein the aluminum substrate is an aluminum substrate having a content of Fe not less than 10 ppm and not more than 1 wt. %.

19. The method according to claim 17, wherein the aluminum substrate is an aluminum substrate having a content of Si not less than 10 ppm and not more than 1 wt. %.

20. The method according to claim 17, wherein the aluminum substrate is an aluminum substrate having a content of Cu not less than 10 ppm and not more than 1 wt. %.

21. A method of manufacturing an electrophotographic photosensitive member, which comprises: (a) providing an aluminum substrate; (b) contacting the surface of the aluminum substrate with water containing a silicate inhibitor; and thereafter (c) forming a functional film made of an amorphous material comprising silicon atoms as a matrix on a surface of the aluminum substrate by reduced-pressure vapor deposition, wherein the film has a thickness not less than 5 Å and not more than 150 Å and contains aluminum, silicon and oxygen as main components in a composition ratio of aluminum:silicon:oxygen=a:b:c: provided that when a=1, $0.1 \leqq b \leqq 1.0$ and $1 \leqq c \leqq 5$.

22. The method according to claim 21, wherein the silicate is potassium silicate.

23. The method according to claim 21, wherein the molar concentration of the inhibitor contained in the water is a range of $10^0$ to $10^{-6}$ mol/l.

24. The method according to claim 21, wherein the step of forming the functional film on the aluminum substrate is a step of forming an amorphous deposited film comprising silicon atoms and at least one kind of hydrogen atoms and fluorine atoms on the aluminum substrate by plasma CVD.

25. The method according to claim 21, wherein the water contains either of a surface-active agent and carbon dioxide.

26. The method according to claim 21, wherein the substrate is cleaned with water at a pressure of 2 to 300 $kg \cdot f/cm^2$.

27. The method according to claim 21, wherein the substrate is dried by raising from hot water.

28. The method according to claim 21, wherein the hot water is at least any one of hot pure water, hot water containing carbon dioxide, and hot water containing the inhibitor.

29. The method according to claim 21, wherein the aluminum substrate is an aluminum substrate having a content of iron not less than 10 ppm.

30. The method according to claim 21, wherein the aluminum substrate is an aluminum substrate having a content of silicon not less than 10 ppm.

31. The method according to claim 21, wherein the aluminum substrate is an aluminum substrate having a content of copper not less than 10 ppm.

32. The method according to claim 21, wherein the aluminum substrate has a total content of iron, silicon and copper exceeding 0.01 wt. % and not more than 1 wt. %.

33. The method according to claim 29, wherein the content of the iron is 1 wt. % or less.

34. The method according to claim 30, wherein the content of the silicon is 1 wt. % or less.

35. The method according to claim 31, wherein the content of the copper is 1 wt. % or less.

36. The method of any one of claims 1, 2–4 or 13–16, wherein step (a) is conducted after step (b).

37. The method of any one of claim 5–8, 9–12 or 17–20, wherein step (a) is conducted after step (c).

38. The method of any one of claims 5–8, 9–12 or 17–20, wherein steps (b) and (c) are conducted simultaneously.

39. The method of claim 38 wherein step (a) is conducted after step (c).

40. The method of claim 5, wherein the concentration of the silicate inhibitor in the water employed in step (c) is from 0.05% to 2%.

41. The method of claim 10, wherein the step of cleaning the surface of the substrate is conducted between steps (c) and (d).

42. The method of claim 5, including a step of rinsing the aluminum substrate with rinsing water containing a silicate inhibitor, wherein said rinsing step is conducted between steps (c) and (d).

43. The method of claim 42, wherein the silicate inhibitor is potassium silicate.

44. The method of claim 42, wherein the concentration of said silicate inhibitor in the rinsing water is from 0.05% to 2%.

45. The method of claim 11, wherein the temperature of the hot pure water employed in the step of drying is from 30° C. to 90° C.

* * * * *